US011359806B2

(12) United States Patent
Huang et al.

(10) Patent No.: US 11,359,806 B2
(45) Date of Patent: Jun. 14, 2022

(54) VENTILATION SYSTEM

(71) Applicant: DELTA ELECTRONICS, INC., Taoyuan (TW)

(72) Inventors: Yu-Hsiang Huang, Taoyuan (TW); Chih-Hua Lin, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 89 days.

(21) Appl. No.: 16/217,677

(22) Filed: Dec. 12, 2018

(65) Prior Publication Data

US 2019/0113221 A1 Apr. 18, 2019

Related U.S. Application Data

(63) Continuation-in-part of application No. 15/797,367, filed on Oct. 30, 2017, now abandoned, which is a (Continued)

(30) Foreign Application Priority Data

Oct. 15, 2014 (TW) ..... 103135619

(51) Int. Cl.
*F21V 33/00* (2006.01)
*F04D 29/60* (2006.01)
(Continued)

(52) U.S. Cl.
CPC ..... *F21V 33/0096* (2013.01); *F04D 29/005* (2013.01); *F04D 29/4226* (2013.01);
(Continued)

(58) Field of Classification Search
USPC ..... 415/121.3; D23/385, 412
See application file for complete search history.

(56) References Cited

U.S. PATENT DOCUMENTS 2,321,907 A 6/1943 Gent
3,068,341 A 12/1962 Ortiz et al.
(Continued)

FOREIGN PATENT DOCUMENTS

CN 102758799 A 10/2012
JP H0517843 U 3/1993
(Continued)

*Primary Examiner* — Robert K Arundale
*Assistant Examiner* — Richard K. Durden
(74) *Attorney, Agent, or Firm* — Muncy, Geissler, Olds & Lowe, PC

(57) ABSTRACT

A ventilation system comprises a ventilation fan with a lamp and a ceiling which has an installation opening. The ventilation fan with the lamp is adapted for installing to the ceiling through the installation opening. The ventilation fan comprises a housing, a fan module, and a lamp module. The housing includes a top plate and a side wall which are connected with each other to form a first opening. The first opening is aligned with the installation opening. The fan module is disposed in the housing. The lamp module is disposed out of the installation opening. The lamp module and the housing are located at opposite sides of the installation opening of the ceiling. The lamp module includes a light source, a base, at least one optical component, a switch and a lamp cover. The optical component and the switch are disposed at the different sides of the base.

8 Claims, 22 Drawing Sheets

Related U.S. Application Data continuation-in-part of application No. 14/616,126, filed on Feb. 6, 2015, now abandoned.

(51) Int. Cl.

| | |
|---|---|
| ***F04D 29/42*** | (2006.01) |
| ***F21V 23/04*** | (2006.01) |
| ***F24F 7/06*** | (2006.01) |
| ***F04D 29/00*** | (2006.01) |
| *F21V 3/00* | (2015.01) |
| *F21Y 115/10* | (2016.01) |
| *F04D 29/28* | (2006.01) |
| *F24F 7/007* | (2006.01) |
| *F21S 8/04* | (2006.01) |
| *F21V 29/74* | (2015.01) |
| *F24F 13/20* | (2006.01) |

(52) U.S. Cl.

CPC ..... *F04D 29/601* (2013.01); *F04D 29/602* (2013.01); *F21V 23/04* (2013.01); *F24F 7/065* (2013.01); *F04D 29/283* (2013.01); *F21S 8/04* (2013.01); *F21V 3/00* (2013.01); *F21V 29/74* (2015.01); *F21Y 2115/10* (2016.08); *F24F 7/007* (2013.01); *F24F 2013/205* (2013.01); *F24F 2221/02* (2013.01); *F24F 2221/14* (2013.01)

(56) References Cited

U.S. PATENT DOCUMENTS

| | | | | |
|---|---|---|---|---|
| 4,681,024 | A | 7/1987 | Ivey | |
| 5,820,458 | A | 10/1998 | Lai | |
| 5,934,783 | A | 8/1999 | Yoshikawa | |
| 6,095,671 | A | 8/2000 | Hutain | |
| 6,149,283 | A * | 11/2000 | Conway | F21V 29/83 362/236 |
| 7,470,043 | B2 | 12/2008 | Mehta | |
| 8,376,583 | B2 * | 2/2013 | Wang | F21V 19/06 362/249.05 |
| 8,382,332 | B2 | 2/2013 | Zakula et al. | |
| 9,416,989 | B1 * | 8/2016 | Tom | F24F 13/078 |
| 9,476,608 | B2 | 10/2016 | Yang et al. | |
| 2008/0062643 | A1 | 3/2008 | Mehta | |
| 2009/0009985 | A1 | 1/2009 | Mehta | |
| 2009/0073702 | A1 | 3/2009 | Craw et al. | |
| 2010/0009621 | A1 | 1/2010 | Hsieh et al. | |
| 2011/0267829 | A1 * | 11/2011 | Horng | F21V 29/74 362/373 |
| 2012/0087128 | A1 * | 4/2012 | Zakula | F21V 33/0088 362/249.02 |
| 2012/0300445 | A1 * | 11/2012 | Chu | F21V 25/04 362/217.13 |
| 2013/0084793 | A1 | 4/2013 | Yang et al. | |
| 2013/0088855 | A1 | 4/2013 | Ye et al. | |
| 2013/0266443 | A1 | 10/2013 | Yang et al. | |
| 2013/0315731 | A1 | 11/2013 | Yang et al. | |
| 2014/0078718 | A1 * | 3/2014 | Li | F21V 33/0088 362/96 |
| 2015/0050876 | A1 * | 2/2015 | Sakai | F24F 11/0001 454/256 |
| 2015/0117034 | A1 | 4/2015 | Horng et al. | |
| 2015/0159910 | A1 | 6/2015 | Huang et al. | |
| 2015/0176833 | A1 * | 6/2015 | Horng | F21V 15/01 362/362 |
| 2015/0276197 | A1 * | 10/2015 | Horng | F21V 29/60 362/294 |
| 2016/0069561 | A1 * | 3/2016 | Jonas | F21V 29/83 362/96 |
| 2016/0108925 | A1 * | 4/2016 | Huang | F04D 29/005 415/121.3 |
| 2017/0010018 | A1 | 1/2017 | Yang et al. | |
| 2019/0318697 | A1 * | 10/2019 | Kumar | H05B 45/24 |

FOREIGN PATENT DOCUMENTS

| | | | |
|---|---|---|---|
| JP | H09303839 | A | 11/1997 |
| TW | 272606 | | 3/1996 |
| TW | M326998 | U | 2/2008 |
| TW | 200834019 | A | 8/2008 |
| TW | 201614175 | A | 4/2016 |
| TW | 201634871 | A | 10/2016 |

* cited by examiner

VENTILATION SYSTEM

CROSS REFERENCE TO RELATED APPLICATIONS

This application is a Continuation-In-Part (CIP) of an earlier filed, pending, application, having application Ser. No. 15/797,367 and filed on Oct. 30, 2017, which is a Continuation-In-Part (CIP) of an earlier filed, pending, application, having application Ser. No. 14/616,126 and filed on Feb. 6, 2015; the entire contents of all of which are hereby incorporated by reference.

BACKGROUND OF THE INVENTION

Field of Invention

The invention relates to a ventilation system, a ventilation fan with a lamp and, in particular, to a ventilation system comprising a ventilation fan with a lamp and installing to a ceiling.

Related Art

For the sake of blocking the outdoor noise and heat and remaining the indoor temperature, the buildings are usually constructed by special materials to create unventilated rooms. Accordingly, a proper ventilation mechanism is required to exhaust the harmful contaminations.

In order to improve the air convection in the rooms, many buildings are equipped with ventilation fans for supplying the fresh air. However, the conventional ventilation fan only has the ventilation function, and the applicability thereof is thus limited.

SUMMARY OF THE INVENTION

A ventilation fan with a lamp according to this invention is used to be installed to a ceiling including an installation opening and comprises a housing, a fan module and a lamp module. The housing includes a first opening and a second opening, and the first opening is aligned with the installation opening. The fan module is disposed in the housing. The lamp module is disposed through the installation opening and the first opening and includes a lamp cover. The lamp cover includes a flange portion and a plurality of contact portions connected to the flange portion. The flange portion and the contact portions are disposed on the side of the ceiling away from the housing. The contact portions are connected to the ceiling to make a gap between the lamp cover and the ceiling, and the gap serves as an air inlet of the ventilation fan.

In one embodiment, the ends of the contact portions connected to the ceiling are connected by a connection element.

In one embodiment, the lamp module further includes a base and a lens. The base is disposed on the lamp cover and inside the housing. The lens is disposed opposite to the base and connected to the lamp cover.

In one embodiment, the fan module includes a fan casing, an impeller and a motor. The fan casing includes an inlet opening and an outlet opening which communicates with the second opening. The impeller is disposed in the fan casing. The motor is connected to and drives the impeller to rotate.

In one embodiment, the outer diameters of the motor and impeller are less than the inner diameter of the first opening, respectively.

In one embodiment, at least half volume of the fan module is on the projection plane of the first opening.

In one embodiment, the housing further includes two extension portions which have slots, and the extension portions are disposed inside the housing.

In one embodiment, the lamp module is fixed to the first opening by a plurality of elastic elements passing through the slots.

In one embodiment, the gap is between 5 mm and 15 mm.

A ventilation fan with a lamp according to this invention comprises a housing, a fan module and a lamp module. The housing includes a first opening and a second opening. The fan module is disposed in the housing. The lamp module is disposed through the first opening and includes a lamp cover. The lamp cover includes a flange portion and a plurality of contact portions connected to the flange portion. The flange portion and the contact portions are disposed outside the housing. The contact portions form a plurality of gaps therebetween, and the gaps serve as an air inlet of the ventilation fan.

In one embodiment, the ends of the contact portions away from the flange portion are connected by a connection element.

In one embodiment, the lamp module further includes a base and a lens. The base is disposed on the lamp cover and inside the housing. The lens is disposed opposite to the base and connected to the lamp cover.

In one embodiment, the fan module includes a fan casing, an impeller and a motor. The fan casing includes an inlet opening and an outlet opening which communicates with the second opening. The impeller is disposed in the fan casing. The motor is connected to and drives the impeller to rotate.

In one embodiment, the outer diameters of the motor and impeller are less than the inner diameter of the first opening, respectively.

In one embodiment, at least half volume of the fan module is on the projection plane of the first opening.

In one embodiment, the housing further includes two extension portions which have slots, and the extension portions are disposed inside the housing.

In one embodiment, the lamp module is fixed to the first opening by a plurality of elastic elements passing through the slots.

In one embodiment, the heights of the contact portions are between 5 mm and 15 mm.

A ventilation fan with a lamp is installed to the ceiling including an installation opening. The ventilation fan includes a housing, a fan module, and a lamp module. The housing has a top plate and a side wall. The top plate and the side wall are connected with each other and form a first opening. The first opening connects to the installation opening. The fan module is accommodated in the housing. The lamp module is disposed out of the installation opening, and the lamp module and the housing are located at opposite sides of the ceiling.

In one embodiment, the fan module is disposed corresponding to the installation opening.

In one embodiment, the fan module has a first projection plane on the top plate, the installation opening has a second projection plane on the top plate, and the first projection plane and the second projection plane are substantially not overlapped.

In one embodiment, the housing further has a bottom plate connected to the side wall. The bottom plate is configured with a second opening. The second opening is smaller than the first opening and is aligned with the installation opening.

In one embodiment, the fan module is disposed corresponding to the second opening and the installation opening.

In one embodiment, the fan module has a first projection plane on the top plate, the installation opening has a second projection plane on the top plate, and the first projection plane and the second projection plane are substantially not overlapped.

In one embodiment, the lamp module is a flat lamp module, and the light output direction of a light source of the lamp module is not equal to the light output direction of the lamp module.

In one embodiment, the light output direction of the light source of the lamp module is perpendicular to the light output direction of the lamp module.

In one embodiment, the fan module has a first projection plane on the top plate, the installation opening has a second projection plane on the top plate, and the size of the first projection plane is smaller than that of the second projection plane.

In one embodiment, the ventilation fan further includes an elastic element disposed on the lamp module. The fan module has a fan frame, and the lamp module is connected to the housing by the elastic element.

In one embodiment, the housing has at least one slot formed by at least one extending portions, and the elastic element penetrates through the slot.

In one embodiment, the lamp module further includes a base, at least one optical component, and a lamp cover. The optical component is disposed on the base, and the lamp cover is disposed at one side of the optical component away from the base.

In one embodiment, the light source comprises at least one light-emitting diode (LED) and the optical component is a light diffuser. The light source is disposed at the side of the light diffuser, and the light diffuser receives the light emitted from the light source.

In one embodiment, the housing further includes an air outlet, and the fan module includes a fan casing, an impeller and a motor. The fan casing includes an inlet opening and an outlet opening, and the outlet opening communicates with the air outlet. The impeller is disposed in the fan casing. The motor is connected to and drives the impeller to rotate.

In one embodiment, the housing has a bottom plate connected to the side wall. The bottom plate is configured with a second opening instead of the first opening. The outer diameters of the motor and the impeller are smaller than the inner diameter of the second opening, respectively.

In one embodiment, at least half volume of the fan module is on the projection plane of the second opening.

In one embodiment, a gap is formed between the lamp module and the ceiling, and the gap serves as a side-entry air inlet of the ventilation fan.

In one embodiment, a width of the gap is between 5 mm and 15 mm.

In one embodiment, the ventilation fan further includes a support disposed between the ceiling and the lamp module.

In one embodiment, a gap is formed between the lamp module and the support, and the gap serves as an air inlet of the ventilation fan.

A ventilation system according to this invention comprises a ventilation fan with a lamp and installing to a ceiling. The ceiling has an installation opening. The ventilation fan with the lamp is adapted for installing to the ceiling through the installation opening. The ventilation fan comprises a housing, a fan module, and a lamp module. The housing includes a top plate and a side wall, wherein the top plate and the side wall are connected with each other to form a first opening, and the first opening is aligned with the installation opening. The fan module is disposed in the housing. The lamp module is disposed out of the installation opening. The lamp module and the housing are located at opposite sides of the installation opening of the ceiling, respectively. The lamp module includes a light source, a base, at least one optical component, a switch and a lamp cover. The optical component and the switch are disposed at the different sides of the base, respectively.

In one embodiment, the lamp cover is disposed at one side of the optical component away from the base.

In one embodiment, the light output direction of the light source of the lamp module is not equal to the light output direction of the lamp module.

In one embodiment, the light source comprises at least one light-emitting diode.

In one embodiment, the optical component is a light diffuser.

In one embodiment, the ventilation system further comprises a support disposed between the ceiling and the lamp module.

In one embodiment, the ventilation system further comprises a contacting portion connected to the lamp module and the support to form a gap serving as an air inlet of the ventilation fan.

In one embodiment, the ventilation system further comprises a second opening disposed at the housing and serving as an air outlet of the ventilation fan.

In one embodiment, the switch is disposed on the base and towards to the installation opening.

In one embodiment, the switch comprises a water-proof structure.

In one embodiment, the switch is a multi-stage switch.

In one embodiment, the switch is disposed to control light color, light color temperature or brightness of the lamp module.

In one embodiment, the ventilation system further comprises a through hole on the lamp cover to serve as an air inlet of the ventilation fan.

In one embodiment, the lamp cover is attached to the ceiling.

In one embodiment, the switch is disposed on the base.

In one embodiment, the switch comprises a water-proof structure.

A ventilation fan with a lamp according to this invention is adapted for installing to a ceiling through an installation opening of the ceiling. The ventilation fan comprises a housing, a fan module and a lamp module. The housing includes a top plate and a side wall, wherein the top plate and the side wall are connected with each other to form a first opening, and the first opening is aligned with the installation opening of the ceiling. The fan module is disposed in the housing. The lamp module is disposed out of the installation opening. The lamp module and the housing are located at opposite sides of the installation opening of the ceiling, respectively. The lamp module includes a light source, a base, at least one optical component, a switch and a lamp cover. The optical component and the switch are disposed at the different sides of the base, respectively.

In one embodiment, the switch is disposed on the base and towards to the installation opening.

In one embodiment, the switch comprises a water-proof structure.

In one embodiment, the switch is a multi-stage switch.

As mentioned above, the ventilation fan with the lamp of this disclosure is installed to the ceiling having an installation opening. The ventilation fan includes a housing, a fan module, and a lamp module. The housing has a top plate and a side wall. The top plate and the side wall are connected with each other and form a first opening. The first opening is aligned with the installation opening. The fan module is disposed in the housing. The lamp module is disposed out of the installation opening, and the lamp module and the housing are located at opposite sides of the installation opening of the ceiling. The lamp module can further block the noise generated by the fan module in operation. Besides, the internal structure of the ventilation fan cannot be viewed by the user directly, so that the appearance of the ventilation fan becomes more elegant. Since the lamp module is integrated in the ventilation fan, it can be fit to various environments so the flexibility and freedom degree for installing the ventilation fan are enhanced. Moreover, this disclosure can reduce the required installation space of the ceiling so as to increase the utility rate of the space. Since the lamp module and the first opening are disposed at opposite sides of the ceiling, the ventilation fan can have large inlet quantity and good air-exchange efficiency. Further, the lamp module has a switch to provide the light dimming function like changing the light color, light color temperature, the brightness and the light frequency, so that the ventilation fan of the disclosure can provide multiple illumination modes for various situations.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

A ventilation system of the present invention comprising a ventilation fan with a lamp and a ceiling having an installation opening. The ventilation fan with the lamp is adapted for installing to the ceiling through the installation opening. The details of the ventilation fan are described as following.

Figure 1A:
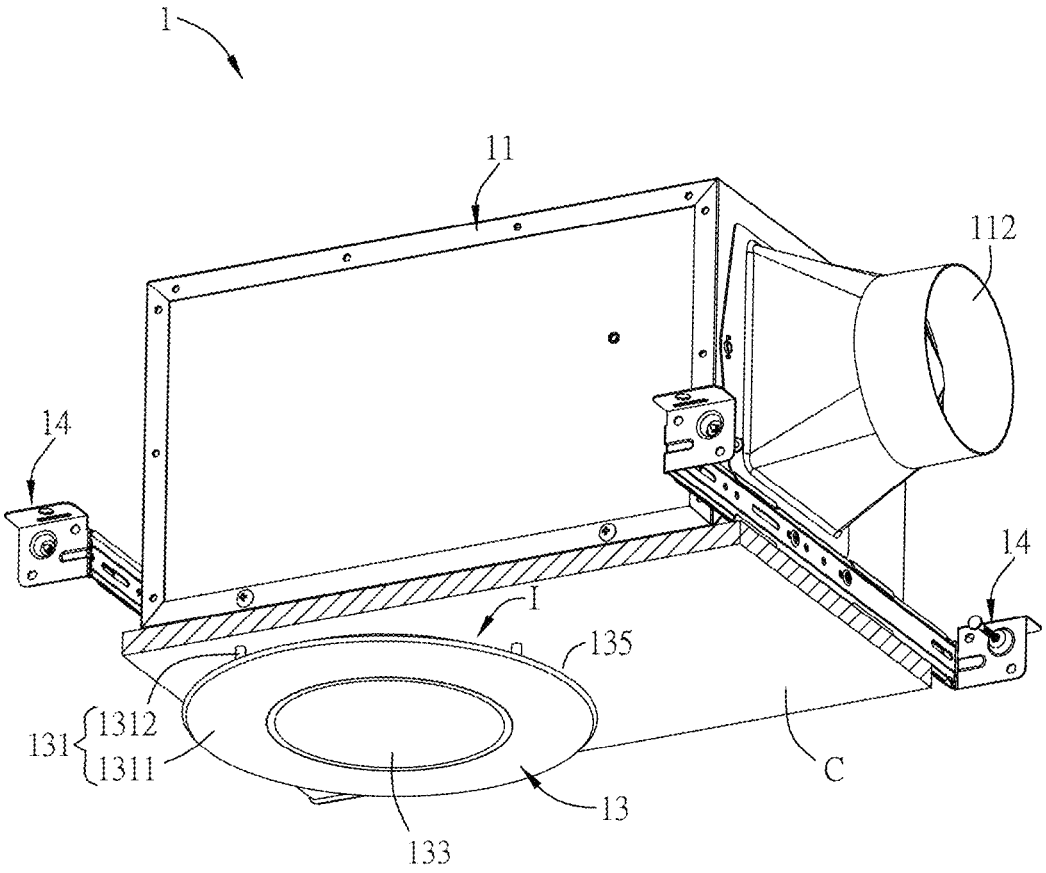
FIG. 1A is a schematic diagram of a ventilation fan with a lamp of the first embodiment of the invention.
Figure 1B:
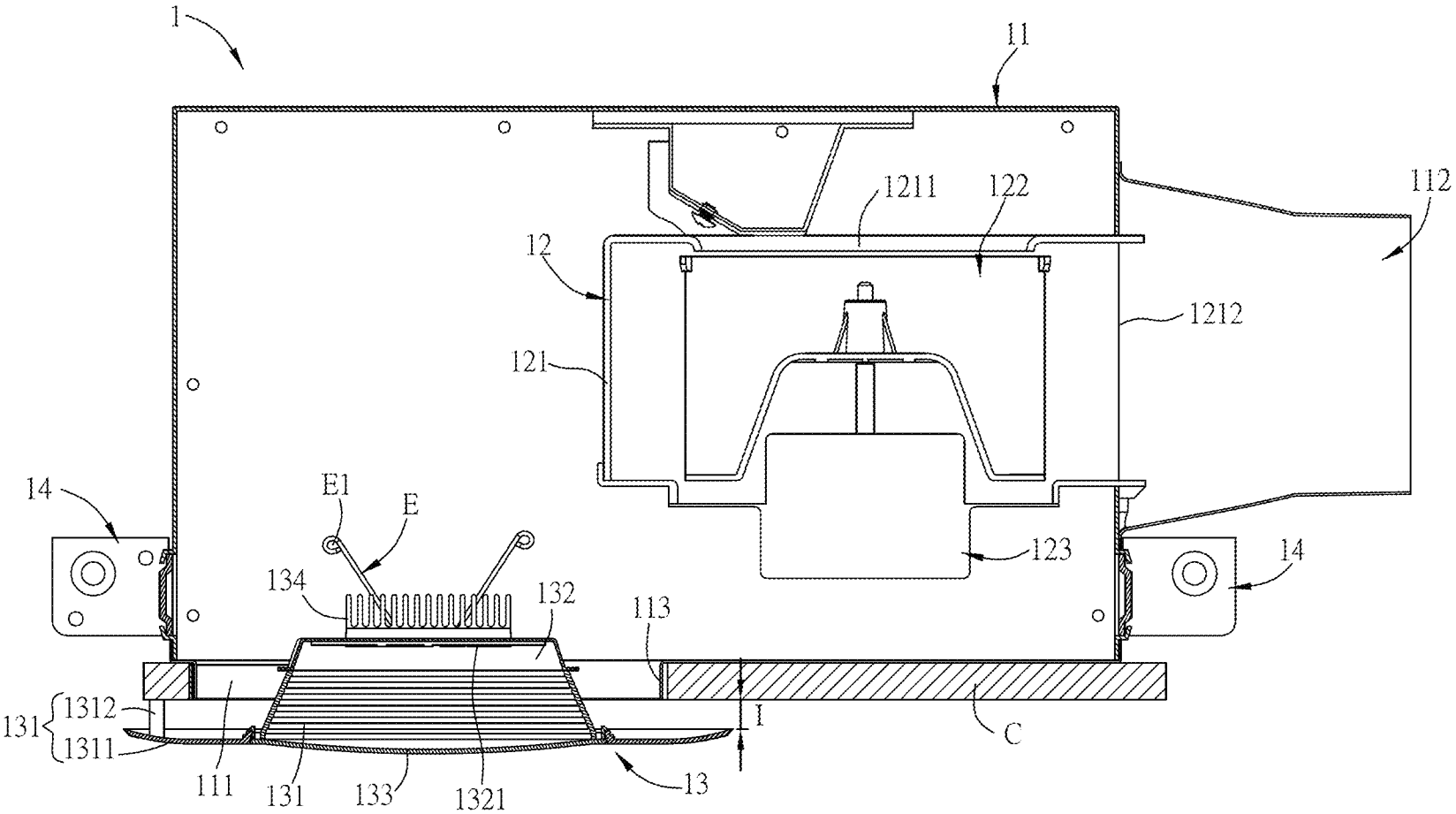
FIG. 1B is a sectional diagram of the ventilation fan in FIG. 1A.
Figure 1C:
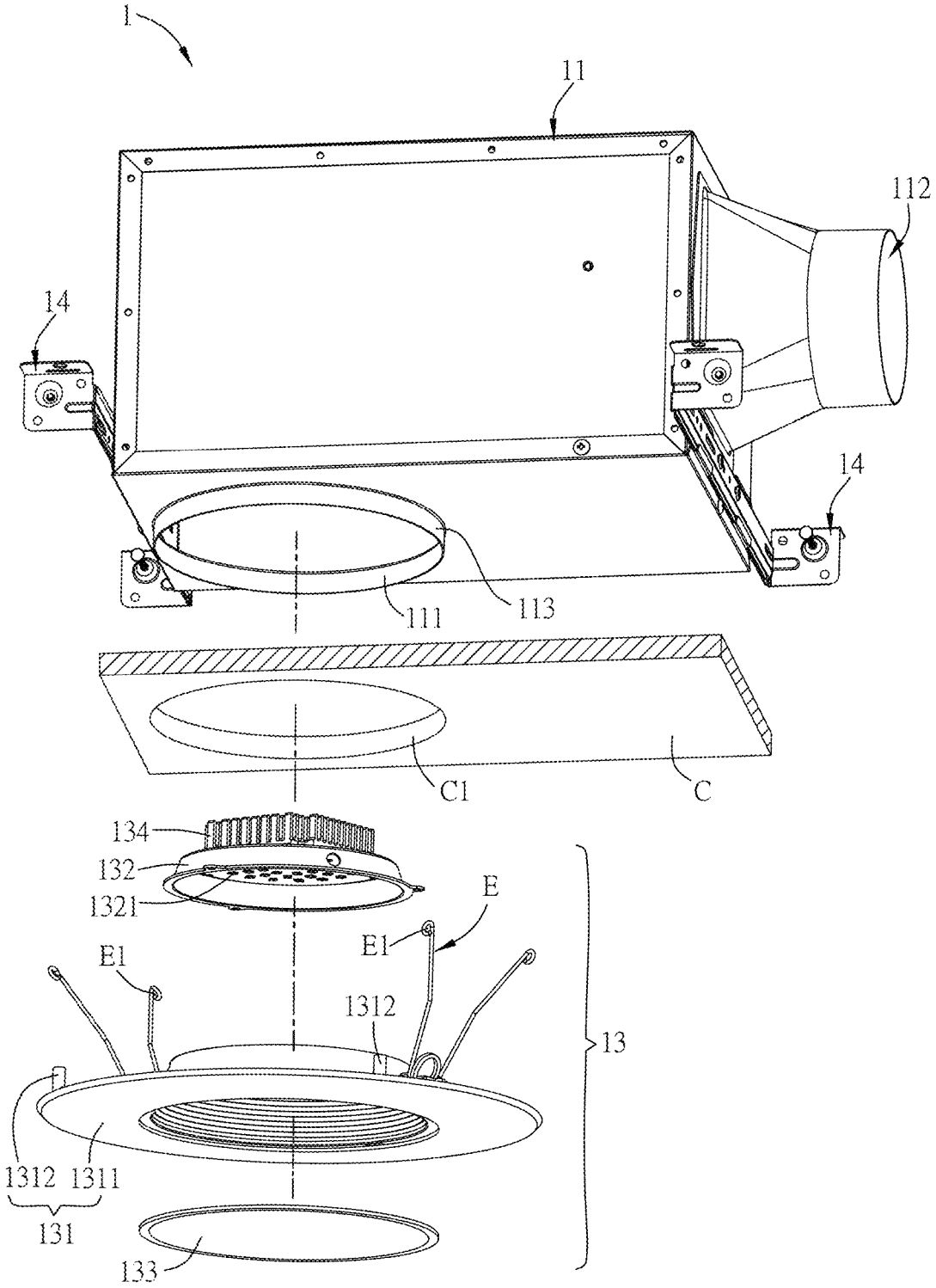
FIG. 1C is a exploded diagram of the ventilation fan in FIG. 1A.

FIG. 1A is a schematic diagram of a ventilation fan with a lamp of the first embodiment of the invention, FIG. 1B is a sectional diagram of the ventilation fan in FIG. 1A, and FIG. 1C is an exploded diagram of the ventilation fan in FIG. 1A. As shown in FIGS. 1A, 1B, 1C, the ventilation fan with the lamp 1 (abbreviated to the ventilation fan 1 hereinafter) is installed to a ceiling C including an installation opening C1. For the clarity of the figure to facilitate the illustration of the ventilation fan of this embodiment, only a part of the ceiling is shown. Herein, the ventilation fan 1 includes a housing 11, a fan module 12 and a lamp module 13. Moreover, the ventilation fan 1 of this embodiment further includes two installation brackets 14, which can be connected to the housing 11 and ceiling C by screwing, for example, to fix the housing 11 to the ceiling C. However, this invention is not limited thereto.

In this embodiment, the housing 11 is approximately a six-sided box structure and includes a first opening 111 and a second opening 112. The first opening 111 and the second opening 112 are located on different sides of the housing 11. In other embodiments, the housing 11 may be a cylindrical box structure, but this invention is not limited thereto. The first opening 111 is aligned with the installation opening C1 of the ceiling C, and the second opening 112 serves as an air outlet of the ventilation fan 1.

The fan module 12 is disposed in the housing 11. In this embodiment, the fan module 12 includes a fan casing 121, an impeller 122 and a motor 123. The impeller 122 is disposed in the fan casing 121, and the motor 123 is connected to the impeller 122 to drive the rotation of the impeller 122. The fan casing 121 includes an inlet opening 1211 and an outlet opening 1212, and the outlet opening 1212 communicates with the second opening 112. Moreover, the impeller 122 and the motor 123 can be fixed in the fan casing 121 by locking or engaging for example.

In this embodiment, the housing 11 includes an annular wall portion 113 disposed at the first opening 111 and extended towards the ceiling C. The height of the annular wall portion 113 is less than or equal to the thickness of the ceiling C, and the outer diameter of the annular wall portion 113 is slightly less than or equal to the inner diameter of the installation opening C1. Therefore, by the annular wall portion 113 fixed into the ceiling C, the lateral displacement of the housing 11 can be avoided.

The lamp module 13 is fixed into the installation opening C1 and the first opening 111. In this embodiment, the lamp module 13 includes a lamp cover 131, a base 132 and a lens 133. The base 132 is disposed on the lamp cover 131 and inside the housing 11. The lens 133 is disposed opposite to the base 132 and connected to the lamp cover 131. Herein for example, the lens 133 is disposed on the side of the lamp cover 131 away from the housing 11, and that is, the lamp cover 131 is disposed between the lens 133 and the base 132. In this embodiment, the base 132 is configured with at least a light emitting element 1321, which can be a bulb or LED lamp for example. Moreover, the lamp module 13 can further include a heat dissipation element 134 such as a heat dissipation fin disposed on the side of the base 132 away from the light emitting element 1321 for the heat dissipation.

The lamp cover 131 includes a flange portion 1311 and a plurality of contact portions 1312 connected with the flange portion 1311. The flange portion 1311 and the contact portions 1312 are disposed outside the housing 11 and especially on the side of the ceiling C away from the housing 11. Besides, the outer diameter of the flange portion 1311 is larger than the diameter of the installation opening C1. In this embodiment, the extension direction of the flange portion 1311 is substantially parallel to the ceiling C. The contact portions 1312 form a plurality of gaps therebetween and are connected to the ceiling C so that a gap is formed between the lamp cover 131 and the ceiling C. The above gap serves as the air inlet I of the ventilation fan 1 and is a side-entry air inlet. Therefore, the height of the air inlet I can be fixed even if the ventilation fan 1 is installed to a thicker or thinner ceiling, because the air inlet I is formed by the contact portions 1312 connected to the ceiling C. That is, the height of the air inlet I is determined by the height of the contact portions 1312. The contact portion 1312 can be a cylindrical structure, taper structure or sheet structure, and the cylindrical structure is given as an example here but not for limiting the scope of the invention. Moreover, the height of the contact portion 1312 or the gap between the lamp cover 131 and the ceiling C can be between 5 mm and 15 mm and favorably 9 mm.

As a whole, when the fan module 12 operates, the motor 12 rotates to drive the rotation of the impeller 122 so that the indoor air enters the housing 11 through the air inlet I. To be noted, the air will flow through the air inlet I and the gap between the installation opening C1 and the lamp cover 131 and also through the gap between the first opening 111 and the lamp cover 131. In other words, the air flows from the outside of the lam cover 131 to the inside of the housing 11. Then, the air will flow through the inlet opening 1211 of the fan casing 121 and flow out through the outlet opening 1212 and the second opening 112. Moreover, the lamp module 13 has a switch (not shown) which can be turned on or off according to the user's requirement. In this embodiment, the lamp module 13 is integrated to the ventilation fan 1, and therefore some of the ceiling space can be released to enhance the usage efficiency of the space.

Figure 2:
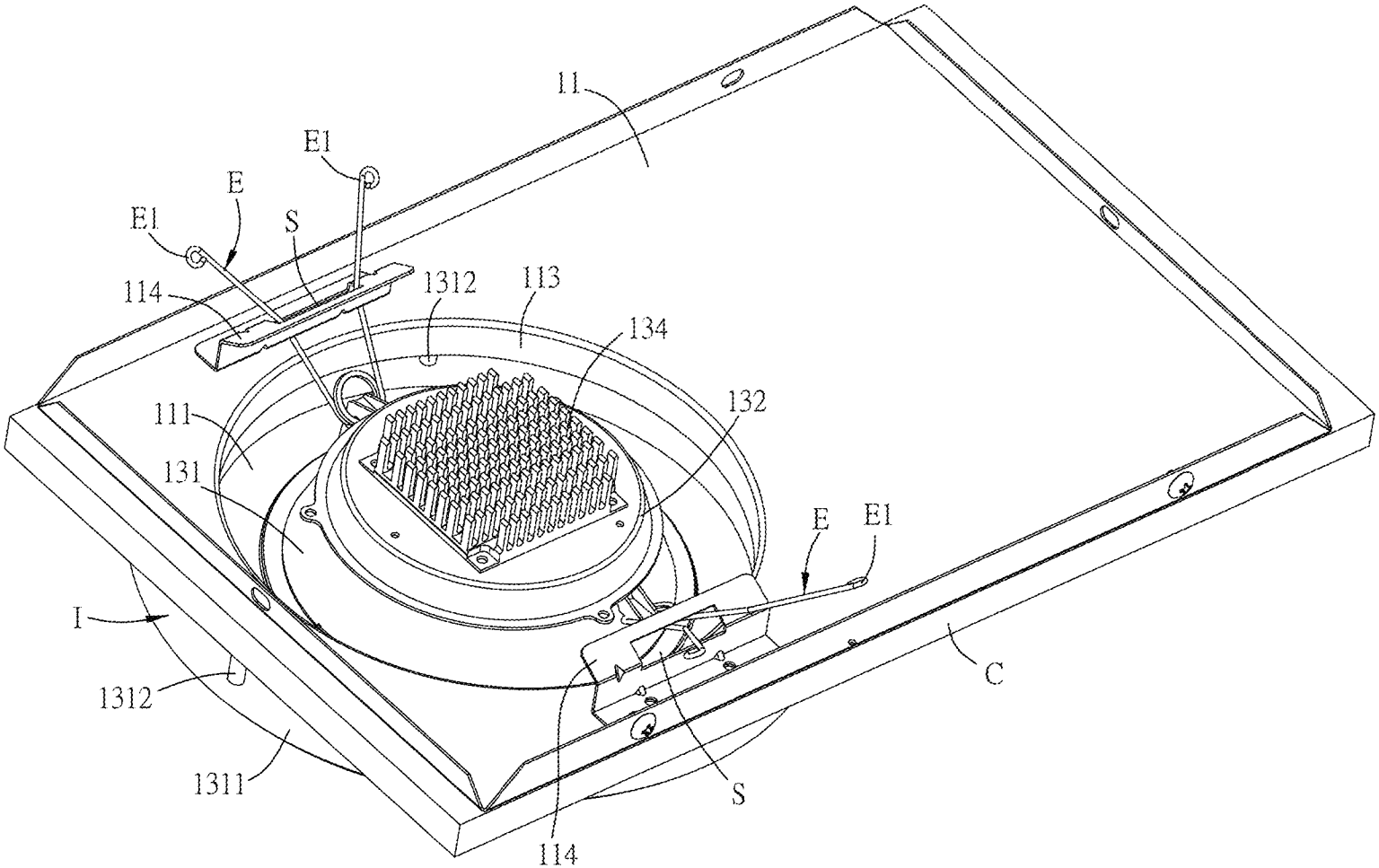
FIG. 2 is a schematic diagram showing the connection of the lamp module and housing.

In this embodiment, the lamp module 13 is fixed to the first opening 111 by two elastic elements E passing through the housing 11. For the convenient illustration, FIG. 2 just shows a part of the housing 11. The elastic element E is roughly a metal element with a V-shaped structure, and the bending portion thereof is connected to the lamp cover 131. Each of two ends of the elastic element E has a hook structure E1. The housing 11 further includes two extension portions 114 which have slots S. The extension portion 114 is disposed inside the housing 11, and the slot S is formed on the extension portion 114. Herein, when the lamp module 13 is mounted to the first opening 111 of the housing 11, the elastic elements E are disposed to pass through the slots S and the hook structures E1 will be fixed to the extension portions 114. When the lamp module 13 is dismounted, the user can dismount the lamp module 13 by directly pulling the lamp module 13 without using any other auxiliary tools. Therefore, the lamp module 13 can be easily dismounted, and this facilitates the maintenance of the ventilation fan 1. Besides, due to the design of the elastic element E, the lamp module 13 will be suspended in the air by the hook structure E1 engaged on the extension portion 114 during the disassembly instead of falling down directly. When the lamp module 13 needs to be completely dismounted, the user can press the elastic elements E to remove it.

The outer diameters of the motor 123 and impeller 122 can be less than the inner diameter of the first opening 111, respectively. That is, the user can dismount the motor 123 and the impeller 122 from the fan casing 121 or mount them to the fan casing 121 through the first opening 111 to facilitate the maintenance of the fan module 12.

As shown in FIG. 1B, in this embodiment, the inlet opening 1211 of the fan casing 121 is located on the surface of the fan casing 121 away from the first opening 111. That is, the inlet opening 1211 and the first opening 111 face the opposite directions and the fan module 12 is disposed reversely. Therefore, through the reverse installation of the fan module 12, when the ventilation fan 1 is installed in the bathroom, the damp won't directly enter the fan module 12 through the air inlet I so that the fan module 12 and the components thereof can be more kept away from the dampness.

Figure 3A:
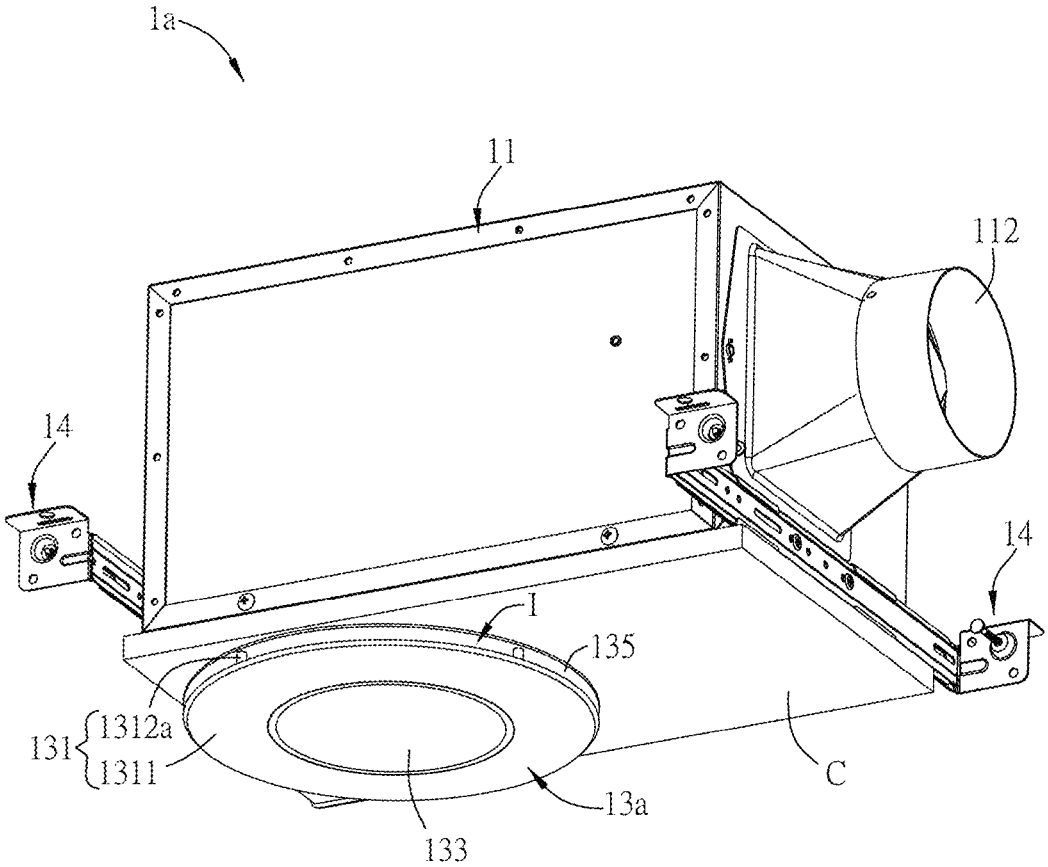
FIG. 3A is a schematic diagram of a ventilation fan with a lamp of the second embodiment of the invention.
Figure 3B:
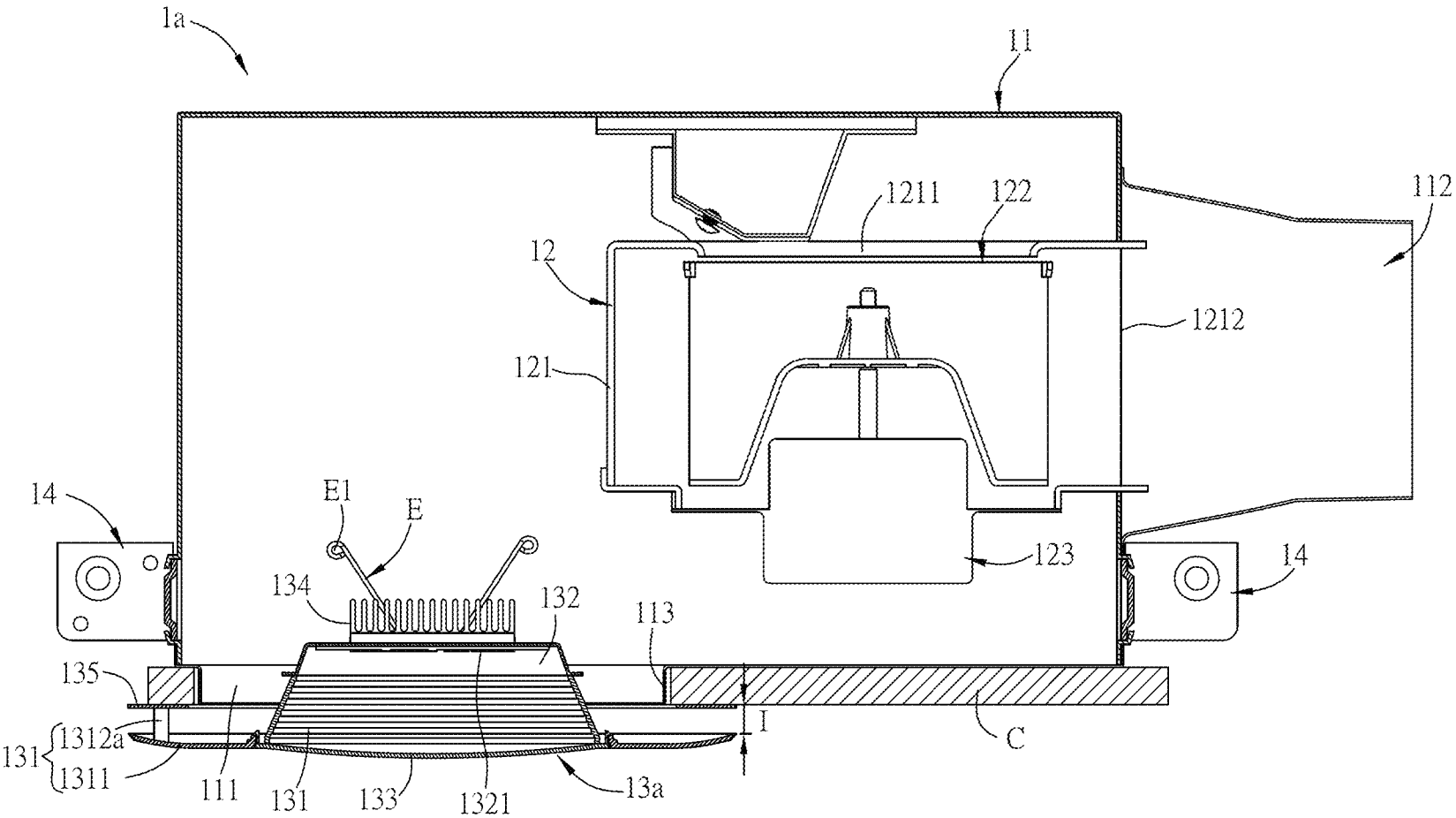
FIG. 3B is a sectional diagram of the ventilation fan in FIG. 3A.

FIG. 3A is a schematic diagram of a ventilation fan with a lamp of the second embodiment of the invention, and FIG. 3B is a sectional diagram of the ventilation fan in FIG. 3A. As shown in FIGS. 3A and 3B, the ventilation fan 1*a* of this embodiment is approximately the same as the first embodiment, and the main difference therebetween is that the ends of the contact portions 1312*a* of the lamp module 13*a* away from the flange portion 1311 (i.e. the ends connected to the ceiling C) are connected by a connection element 135. In this embodiment, the connection element 135 is an annular plate and disposed parallel to and separately from the flange portion 1311. The connection element 135 and the contact portions 1312*a* are collectively connected to the ceiling C to provide a better look. The illustration of the housing 11 and fan module 12 can be comprehended by referring to the first embodiment and therefore is omitted here for conciseness.

Figure 3C:
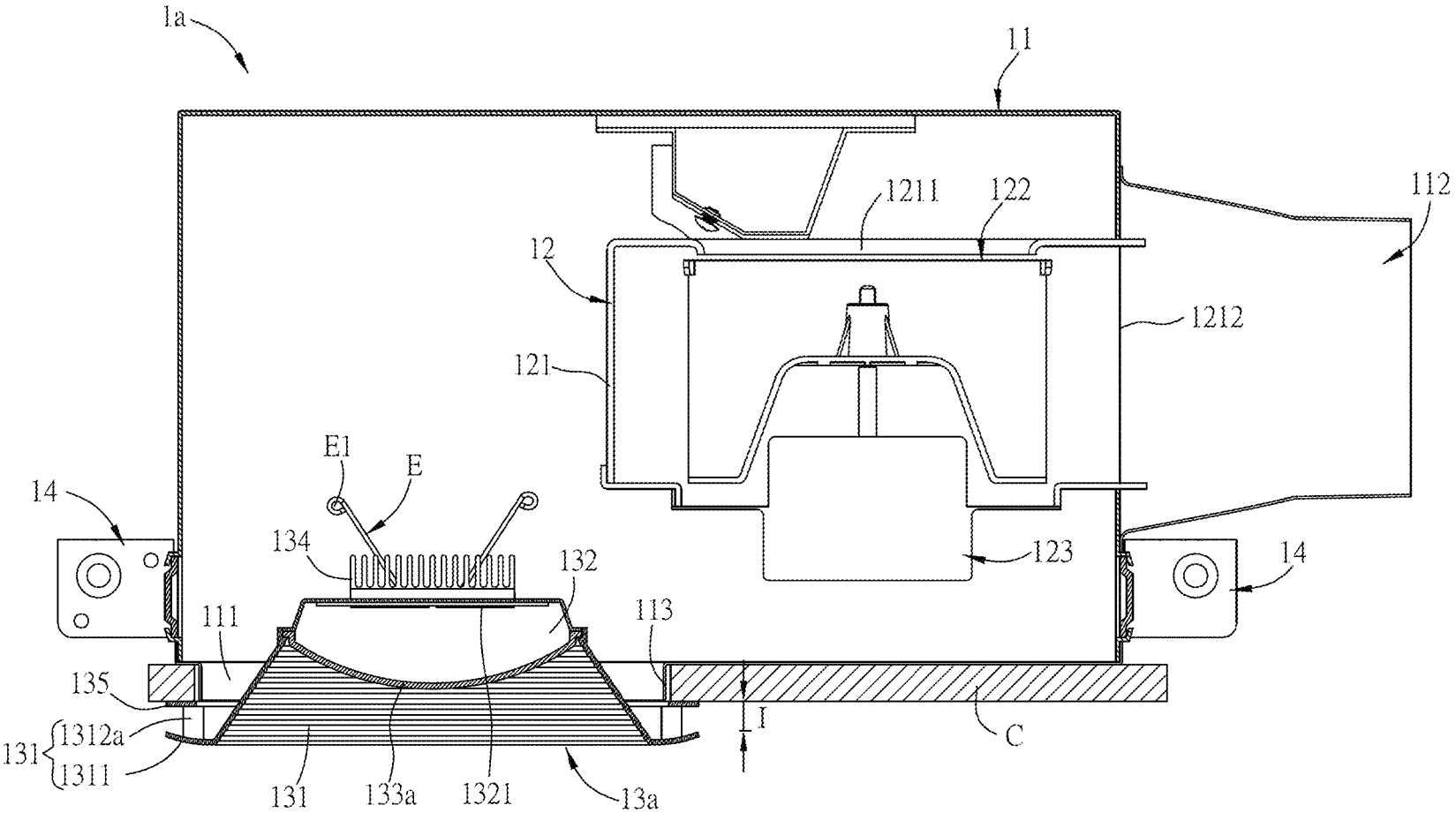
FIG. 3C is a schematic sectional diagram of a ventilation fan of another embodiment of the invention.

FIG. 3C is a schematic sectional diagram of a ventilation fan of another embodiment of the invention. As shown in FIG. 3C, this embodiment is approximately the same as the above second embodiment, and the main difference therebetween is that the lens 133*a* is disposed between the lamp cover 131 and the base 132 and inside the housing 11. Certainly, the lens 133*a* also can be disposed at the first opening 111 so that a part of the lens 133*a* is disposed inside the housing and another part of the lens 133*a* is exposed from the housing 11.

Figure 4:
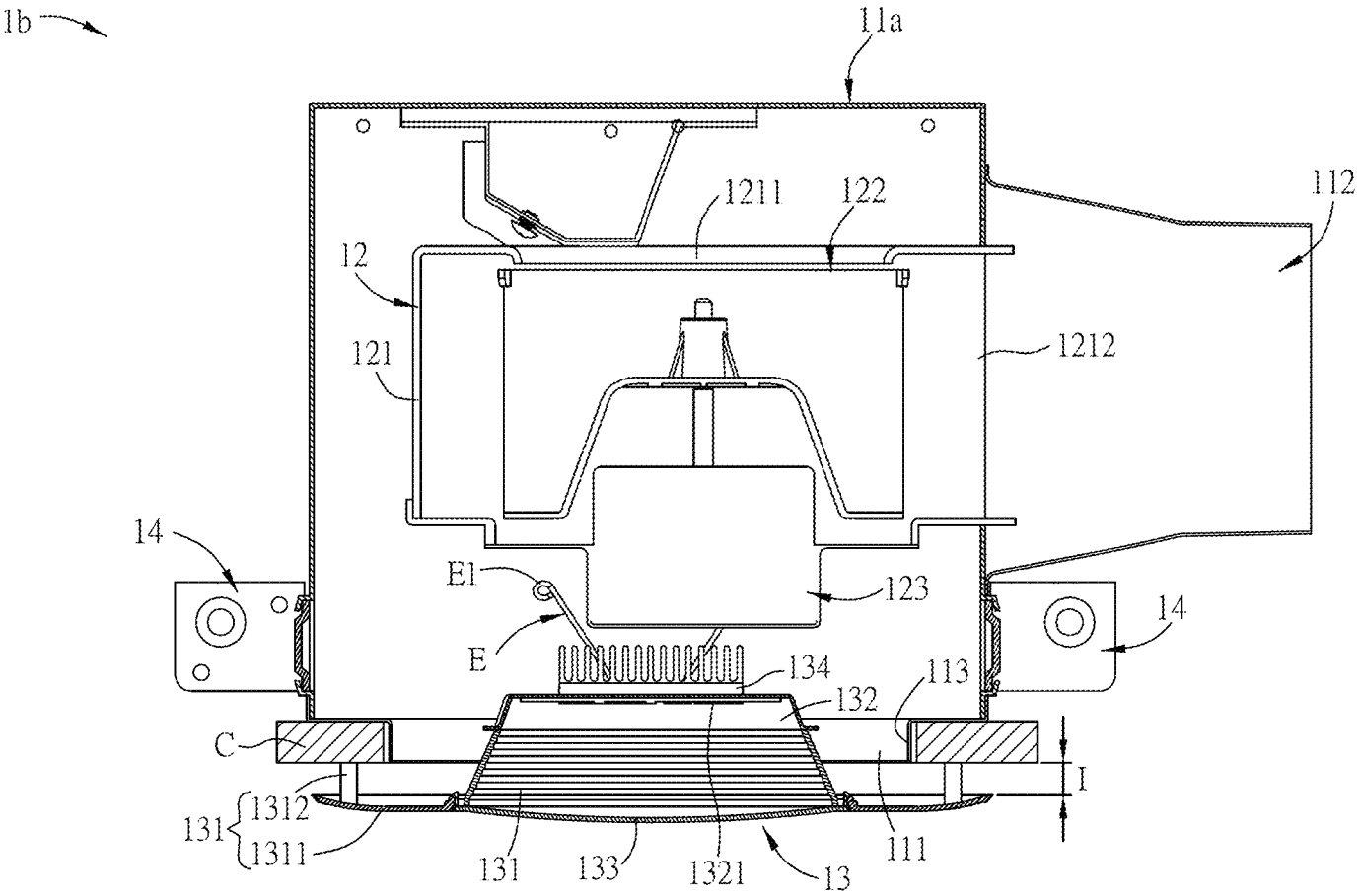
FIG. 4 is a schematic sectional diagram of a ventilation fan with a lamp of the third embodiment of the invention.

FIG. 4 is a schematic sectional diagram of a ventilation fan with a lamp of the third embodiment of the invention. As shown in FIG. 4, the ventilation fan 1*b* of this embodiment is approximately the same as the first embodiment, and the main difference therebetween is that the size of the housing 11*a* of this embodiment is less than that of the housing 11 of the above embodiment so that at least half volume of the fan module 12 is on the projection plane of the first opening 111. Thereby, the space in the ceiling interlayer for installing the ventilation fan 1*b* can be lessened to enhance the space usage efficiency. Moreover, in some embodiments, the lamp module 13 can be replaced by the lamp module 13*a* of the second embodiment. That is, the lamp module 13*a* including the connection element 135 is disposed at the housing 11*a* with a smaller size. Furthermore, the descriptions of the fan modules 12 and 13 can be comprehended by referring to the first embodiment and are therefore omitted for conciseness.

Accordingly, the lamp module of the disclosure is integrated to the ventilation fan and thereby the used space of the ceiling can be reduced to enhance the space usage efficiency.

Figure 5A:
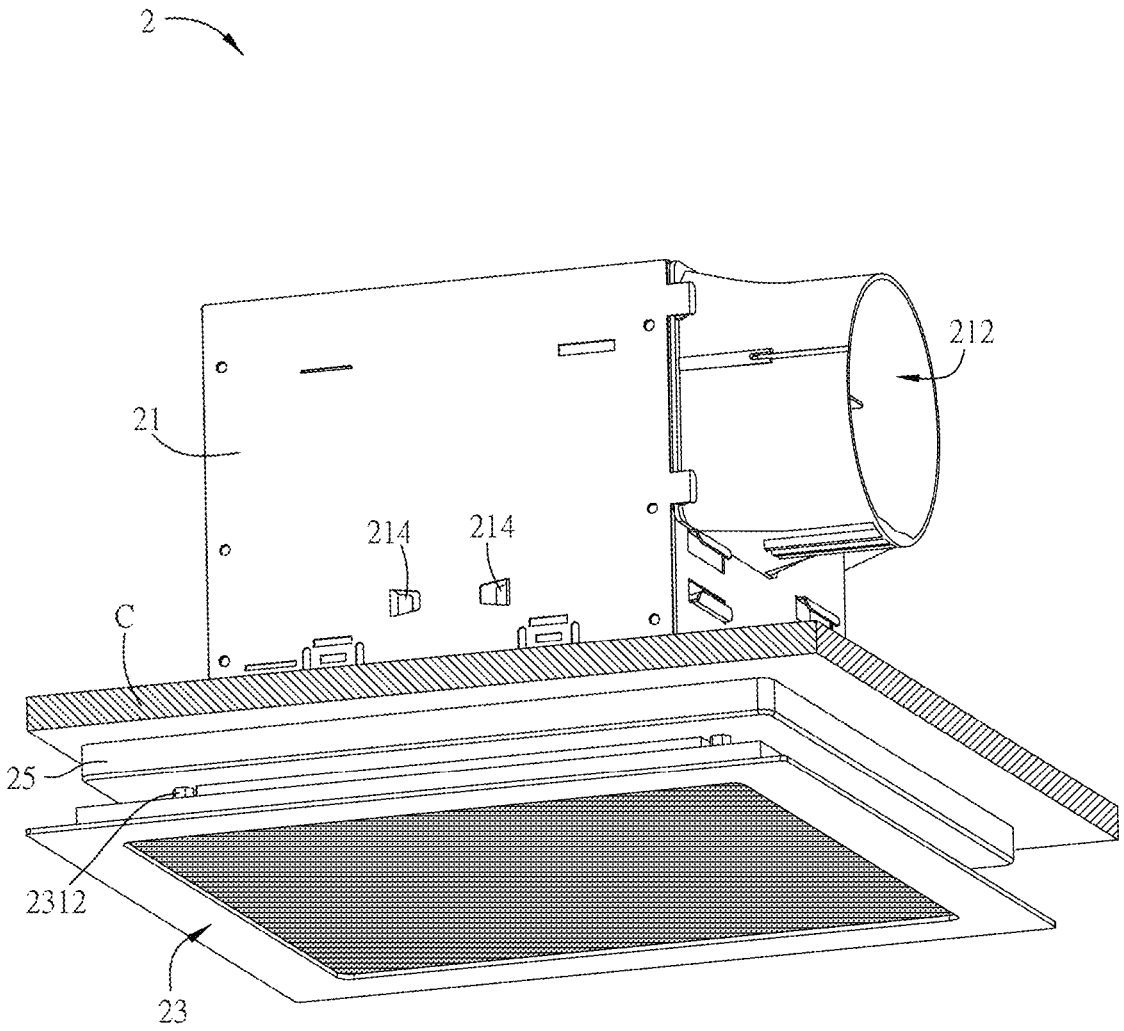
FIG. 5A is a schematic diagram of a ventilation fan with a lamp of the fourth embodiment of the invention.
Figure 5B:
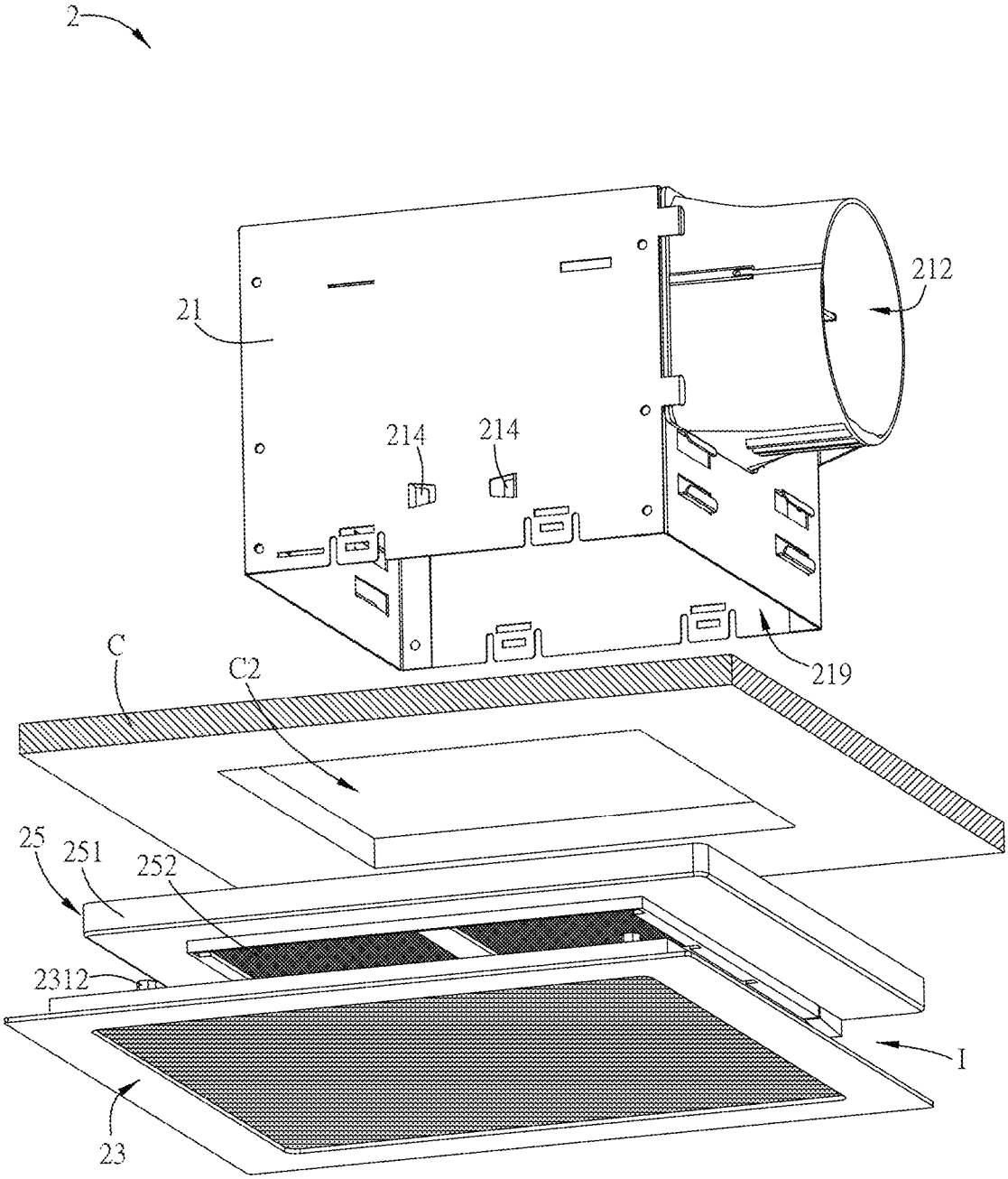
FIG. 5B is an exploded view of the ventilation fan of FIG. 5A, which has a support.
Figure 5C:
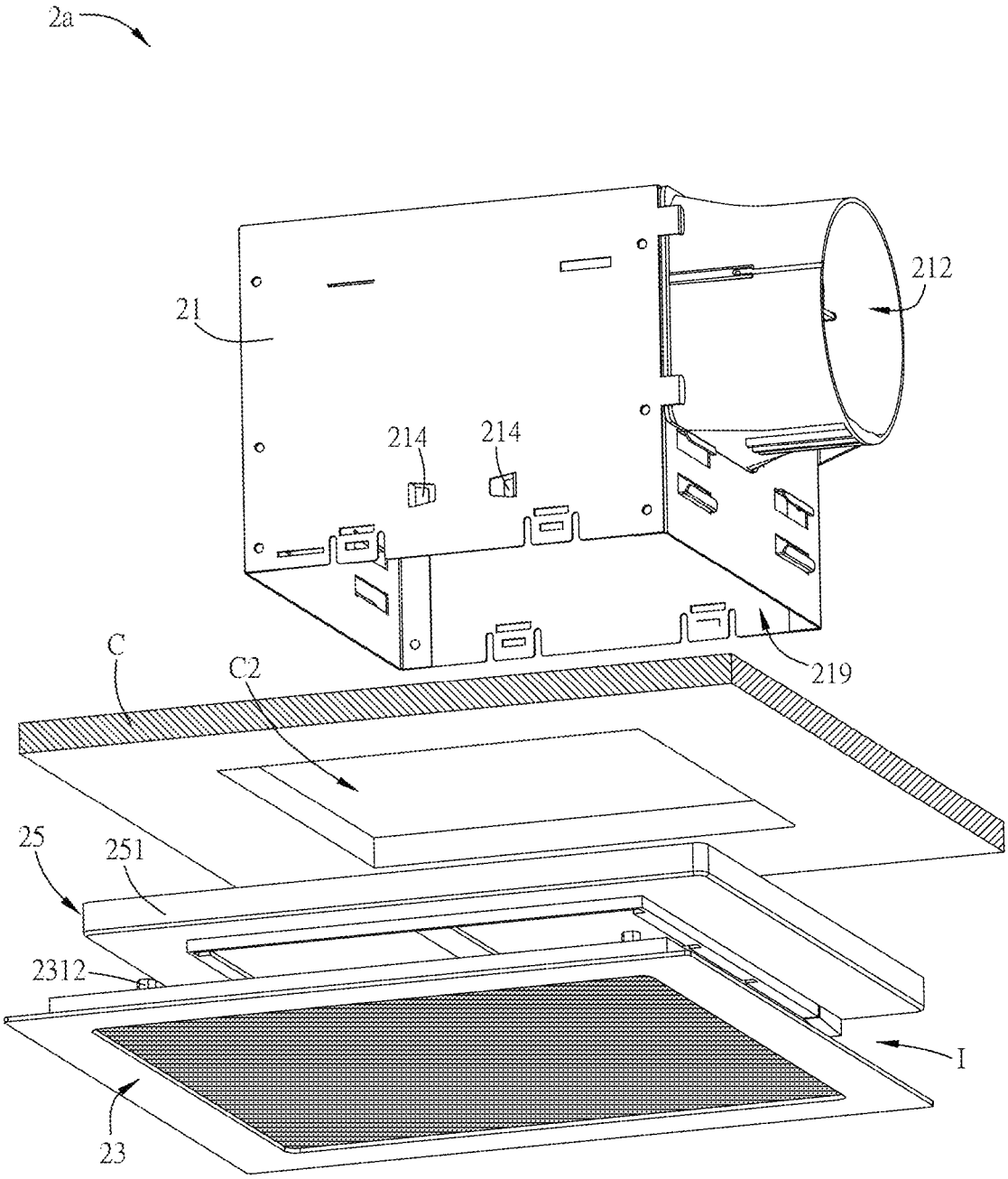
FIG. 5C is an exploded view of the ventilation fan of FIG. 5A with a variation.
Figure 5D:
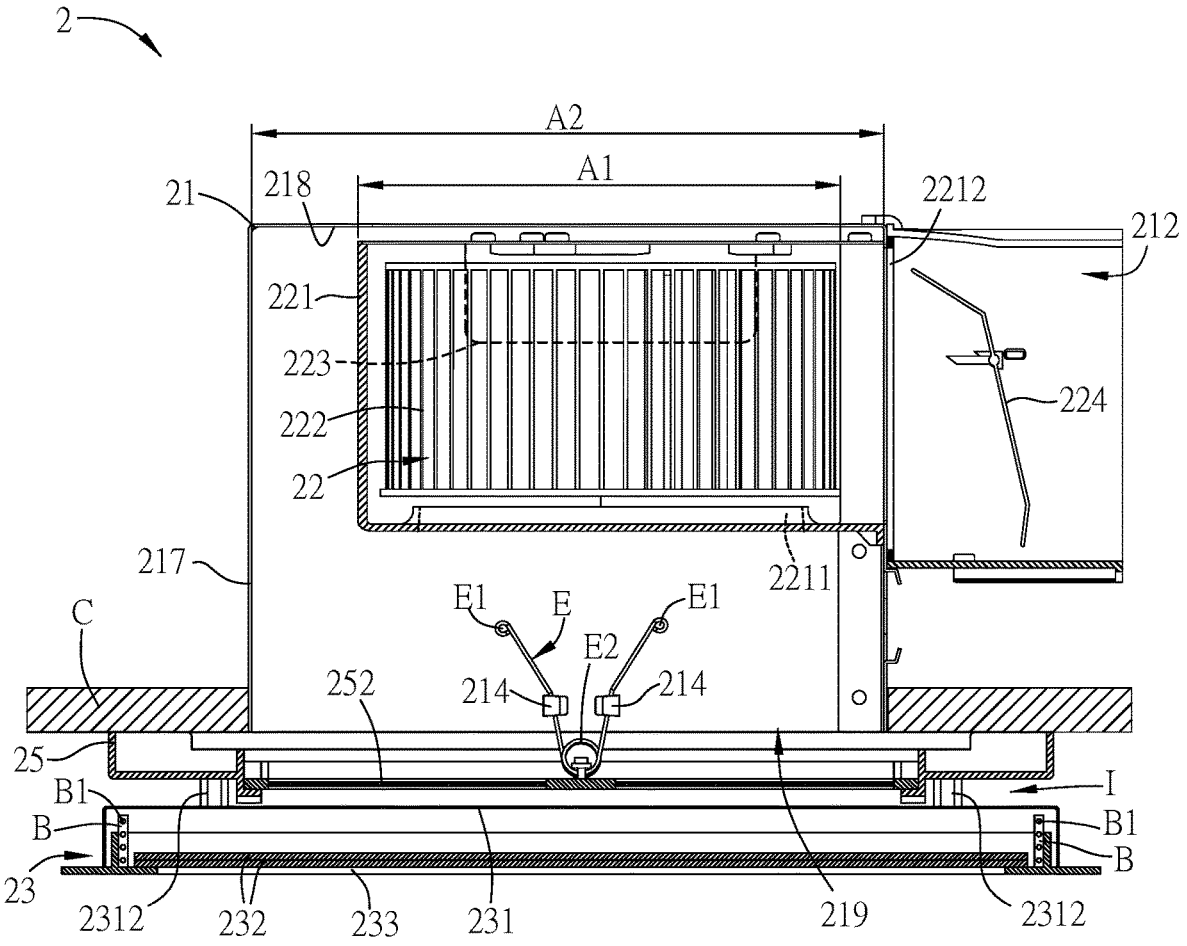
FIG. 5D is a sectional diagram of the ventilation fan of FIG. 5A.
Figure 9A:
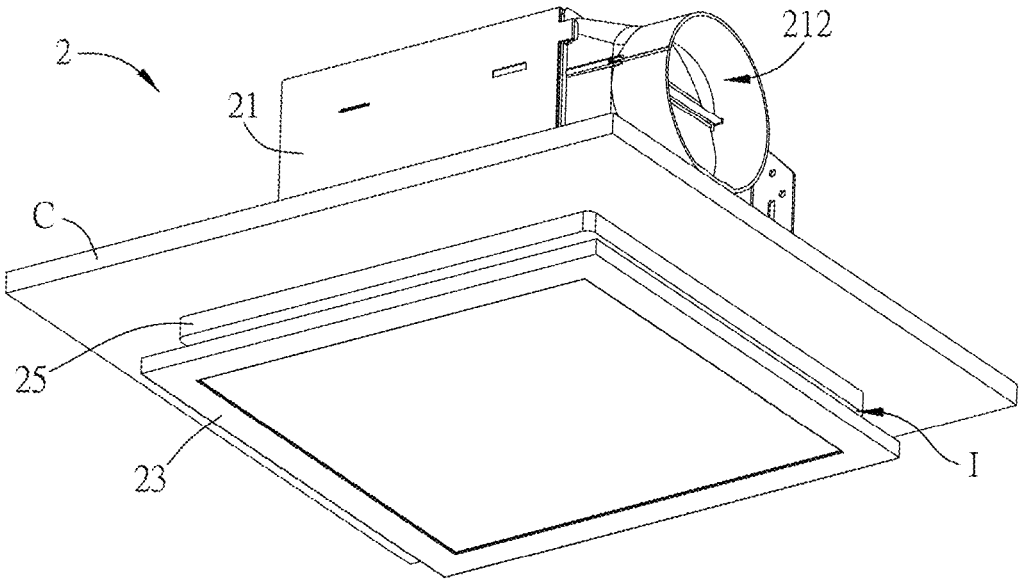
FIG. 9A is another schematic diagram of a ventilation fan with a lamp of the fourth embodiment of the invention.
Figure 9B:
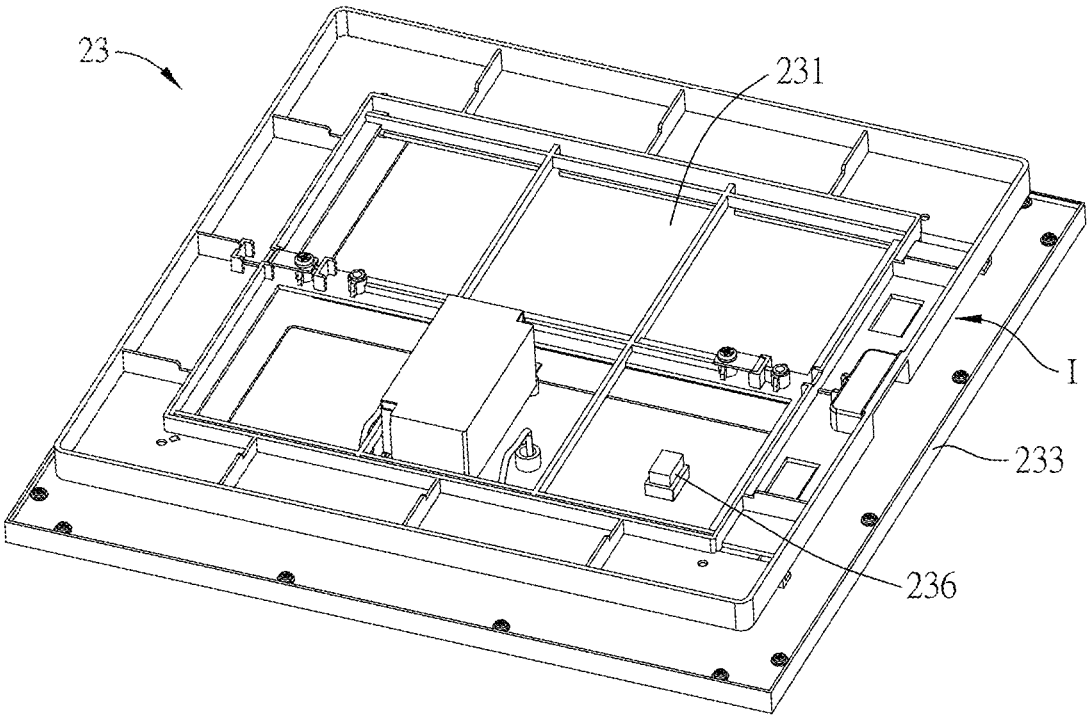
FIG. 9B is a schematic diagram of the lamp module of FIG. 9A.

FIG. 5A is a schematic diagram of a ventilation fan with a lamp of the fourth embodiment of the invention; FIG. 5B is an exploded view of the ventilation fan of FIG. 5A, FIG. 5C is an exploded view of the ventilation fan of FIG. 5A with a variation, and FIG. 5D is a sectional diagram of the ventilation fan of FIG. 5A. FIG. 9A is another schematic diagram of a ventilation fan with a lamp of the fourth embodiment of the invention. FIG. 9B is a schematic diagram of the lamp module of FIG. 9A.

As shown in FIGS. 5A to 5D, and 9A to 9B, the ventilation fan 2/2*a* is installed to the ceiling C, and the ceiling C has an installation opening C2. Briefly, the ventilation fan 2/2*a* is adapted for installing to the ceiling C through the installation opening C2. To be noted, only a part of the ceiling C is shown in the figures for making the drawings more clear. In this embodiment, the ventilation fan 2 includes a housing 21, a fan module 22, and a lamp module 23. In addition, the ventilation fan 2 further includes a support 25 for installing with the installation holes (not shown) of the housing 21. The housing 21 can be connected to and fixed to the ceiling C by, for example but not limited to, screws.

In this embodiment, the housing 21 is roughly a rectangular box and has a top plate 218 and a side wall 217. The side wall 217 includes four perpendicular plates. The top plate 218 and the side wall 217 are connected with each other so as to form a first opening 219. The top plate 218 and the side wall 217 can be integrally formed as one piece or formed by assembling multiple components. Besides, the top plate 218 and the side wall 217 can be fabricated by dustproof, waterproof or fireproof material (e.g. plastics, metal or alloy). In addition, the housing 21 may further include at least one extending portion 214 disposed on the side wall 217 to form a slot. In this embodiment, the extending portion 214 can be formed by punching or pressing the housing 21, and the elastic element E can be connected to the housing 21 through the extending portion 214 so that the lamp module 23 can be fixed.

In more detailed, the side wall 217 includes four plates perpendicular to the top plate 218. The top plate and side wall of the housing 21 may have different shapes. For example, the housing may have polygonal side walls, arc side walls, or cylindrical box, and this disclosure is not limited. In addition, the first opening 219 can be formed by removing the bottom of a rectangular box, i.e. the housing 21. In other words, the housing 21 can be a rectangular box or pentagon box without the bottom. Referring to the exploded view and sectional diagram of FIGS. 5B to 5D, the housing 21 is a reversed U-shaped box without the bottom.

In addition, the housing 21 may further include a second opening disposed at the housing 21 and serving as an air outlet 212, which is configured to discharge air or connect the external air channel. In this embodiment, the first opening 219 and the air outlet 212 are located at different planes of the housing 21. The housing 21 of the ventilation fan 2 can be installed to the installation opening C2 of the ceiling C. The first opening 219 can be aligned with the installation opening C2 of the ceiling C so that the installation opening C2 can be communicated with the first opening 219. Besides, the inner diameters of the first opening 219 of the housing 21 and the installation opening C2 of the ceiling C substantially have the same size.

The fan module 22 is disposed in the housing 21. In this embodiment, the fan module 2 includes a fan casing 221, an impeller 222, and a motor 223. The fan module 22 is disposed corresponding to the installation opening C2. In other words, as shown in FIG. 5D, the fan module 22 is right above the installation opening C2 of the ceiling C. This disclosure is not limited. The impeller 222 is disposed in the fan casing 221. The motor 223 is connected to and drives the impeller 222 to rotate. Preferably, the motor 223 can be a DC motor, which has lower power consumption. The fan casing 221 has an inlet opening 2211 and an outlet opening 2212, and the outlet opening 2212 communicates with the air outlet 212. The impeller 222 and the motor 223 can be fixed inside the fan casing 221 by screwing or locking. In addition, the outer diameters of the motor 223 and the impeller 222 are smaller than the inner diameter of the first opening 219, respectively. In other words, the user may uninstall the motor 223 and the impeller 222 from the fan casing 221 through the first opening 219, or install the motor 223 and the impeller 222 into the fan casing 221 through the first opening 219. This configuration is benefit to the repairing or maintenance of the fan module 22.

As shown in FIG. 5D, the fan module 22 has a first projection plane A1 on the top plate 218, and the installation opening C2 has a second projection plane A2 on the top plate 218. The size of the first projection plane A1 is smaller than that of the second projection plane A2, and the first projection plane A1 is at least partially overlapped with the second projection plane A2. Accordingly, the fan can be individually removed through the first opening 219 of the housing 21 and the installation opening C2 of the ceiling C for maintenance procedure.

As shown in FIG. 5D and FIG. 9B, the lamp module 23 is disposed out of the installation opening C2 of the ceiling C, and the lamp module 23 and the housing 21 are located at opposite sides of the installation opening C2 of the ceiling C, respectively. In this embodiment, the lamp module 23 is a flat lamp module. In more detailed, the lamp module 23 includes a light source B, a base 231, at least one optical component 232, and a lamp cover 233. The optical component 232 is disposed on the base 231, and the lamp cover 233 is disposed at one side of the optical component 232 away from the base 231. In this embodiment, the light source comprises at least one light-emitting diode (LED) B1 and disposed at the side of the optical component 232. The LED B1 and the driver thereof can be integrated in one substrate together, i.e. "driver on board (DOB)", and this disclosure is not limited thereto.

In this embodiment, the optical component 232 is a light diffuser, which is configured to receive the light emitted from the light source of the lamp module 23. As shown in figures, the light emitted from the light source B of the flat lamp module 23 enters the optical component 232. In this embodiment, the light can enter the light diffuser, pass through the lamp cover 233, and then be emitted out departing from the ceiling and the housing 21 to obtain a uniform-and-plane light. In other words, the light output direction of the light source B of the lamp module 23 is not equal to the light output direction of the lamp module 23. In this case, the light output direction of the light source of the lamp module 23 is substantially perpendicular to the light output direction of the lamp module 23.

In this embodiment, the lamp module 23 has a flat design and is configured with the diffuser for obtaining a uniform-and-plane light. Compared with the conventional LED light source, the lamp module 23 of this embodiment can provide the light with uniform, softness and non-dazzling lighting sensitivity. In addition, the lamp module 23 further includes a heat-dissipating element (e.g. a heat sink), which can be disposed on the base 231 or attached to the substrate for dissipating heat.

As shown in FIG. 5D and FIG. 9B, the lamp module 23 can further has a switch 236. The switch 236 is disposed on the base 231 and towards to the installation opening C2. The optical component 232 and the switch 236 are disposed at the different sides of the base 231, respectively. Therefore, the switch 236 of the ventilation fan cannot be viewed by the user directly, so that the appearance of the ventilation fan becomes more elegant. In other embodiments, the switch 236 comprises a water-proof structure, for example but not limited to, rubber or plastic which covers the switch 236. The water-proof structure can protect the switch from the steam in the air to avoid damaging the switch 236. In other embodiments, the switch 236 is a multi-stage switch which provides the light dimming function based on various situations. For example, the light dimming function may change the light color, light color temperature, the brightness and the light frequency, so that the ventilation fan of the disclosure can provide multiple illumination modes for various situations. In other embodiments, the lamp module 23 may utilize different optical components for various illumination requirements. For example, the optical component may include a lens or a lens set. The lens is disposed opposite to the base and connected to the lamp cover for providing different illumination effects according to the light concentration and divergence abilities of the lens.

The ventilation fan of this embodiment further includes an elastic element, which will be described hereinafter.

As shown in FIG. 5D, the ventilation fan 2 further includes an elastic element E. The lamp module 23 can be fixed outside of the installation opening C2 of the ceiling C by disposing the elastic element E through the extending portion 214 of the housing 21. In other embodiments, the housing 21 may have multiple extending portions 214. This configuration can further firmly fix the lamp module 23 when installing the ventilation fan 2. In more specific, the elastic element E is roughly a metal element with a V-shaped structure, and each of two ends of the elastic element E has a hook structure E1. A ring structure E2 is configured at the bottom of the V-shaped structure and between the two hook structures E1. The ring structure E2 is partially connected to the outer case of the lamp module 23.

When installing the lamp module 23 outside the installation opening C2 of the ceiling C, the two hook structures E1 are pressed to close to each other, so that the elastic element E can pass through the extending portion 214 of the housing 21. Then, the two hook structures E1 are released and hooked to the extending portion 214. When uninstalling the lamp module 23, the user can press the two hook structures E1 to close to each other, and then remove the hook structures E1 from the extending portion 214. Thus, the lamp module 23 can be easily pulled down and released from the fixing status, and no additional tool is needed. This feature allows to easily install and uninstall the lamp module 23 and is benefit to the repairing and maintenance of the ventilation fan 2. Due to the design of the elastic element E, the lamp module 23 can be suspended during uninstalling the lamp module 23 when the hook structures are still stuck in the extending portion 214. Besides, the user can press the hook structures E1 of the elastic element E to remove the lamp module 23.

After fixing the lamp module 23 on the installation opening C2 of the ceiling C by the elastic element E, the lamp module 23 can be contacted against the ceiling C. In this embodiment, the support 25 contacts the ceiling C, and a gap I is configured between the lamp module 23 and the support 25. In practice, the gap I serves as an air inlet of the ventilation fan 2. In more specific, the gap I is disposed between the lower surface of the support 25 and the upper surface of the outer case of the lamp module 23, and the gap I is called a side-entry air inlet.

In this embodiment, the configuration of the elastic element E can absorb the installation gap between the support 25 and the ceiling C. The lamp module 23 and the support 25 are connected by the contact portion 2312. Herein, the length of the gap I, which serves as the air inlet, is substantially between 5 mm and 20 mm.

The operation of the ventilation fan 2 will be described hereinafter.

To be noted, the airflow can flow from the gap I to the place between the ceiling C and the lamp module 23, and pass through the installation opening C2 of the ceiling C and the first opening 219 of the housing 21, and then enter the housing 21. As shown in FIG. 5D, the inlet opening 2211 of the fan casing 221 is disposed on the surface of the fan casing 221 close to the first opening 219 so that the inlet opening 2211 and the first opening 219 are facing toward the same direction. Accordingly, the inlet opening 2211 of the fan module 22 can directly guide the air inputted from the gap I, thereby increasing the air input efficiency. Then, the air flows through the inlet opening 2211 of the fan casing 221 and flows out through the outlet opening 2212 and the air outlet 212 of the housing 21. In addition, the fan module 22 of this embodiment further includes a baffle plate 224 disposed in the air outlet 212. When the fan module 22 is not in operation, the baffle plate 224 can prevent the reverse flow of the air outside the air outlet 212. Moreover, the lamp module 23 may have an independent switch so that the user can individually turn on/off the lamp module 22 with regard less the operation of the fan module 22. In other words, the air-exchanging function and the illumination function can be separately controlled.

As mentioned above, the ventilation fan 2 of this embodiment is installed to the ceiling C having an installation opening C2. The ventilation fan 2 includes a housing 21, a fan module 22, and a lamp module 23. The housing 21 has a top plate 218 and a side wall 217. The top plate 218 and the side wall 218 are connected with each other and form a first opening 219. The first opening 219 connects to the installation opening C2. The fan module 22 is accommodated in the housing 21. The lamp module 23 is disposed out of the installation opening C2 of the ceiling C, and the lamp module 23 and the housing 21 are located at opposite sides of the ceiling C. The ventilation fan 2 has a side-entry air inlet design, so that the lamp module 23 can block the noise generated by the fan module 22 in operation. Besides, the internal structure of the ventilation fan 2 cannot be viewed by the user directly so that the appearance of the ventilation fan 2 becomes more elegant. Since the lamp module 23 is integrated in the ventilation fan 2, it can be fit to various environments and reduce the required installation space of the ceiling C so as to increase the utility rate of the space.

Some aspects of the support 25 of the ventilation fan will be described hereinafter.

The ventilation fans 2 and 2*a* of FIGS. 5B and 5C are different in the filter 252 disposed in the support 25. In the ventilation fan 2 of FIG. 5B, the filter 252 is a pre-filter. The filter 252 can be optionally installed or removed based on the requirement of the user. As shown in FIG. 5C, the ventilation fan 2*a* is not configured with the filter 252.

Figure 6A:
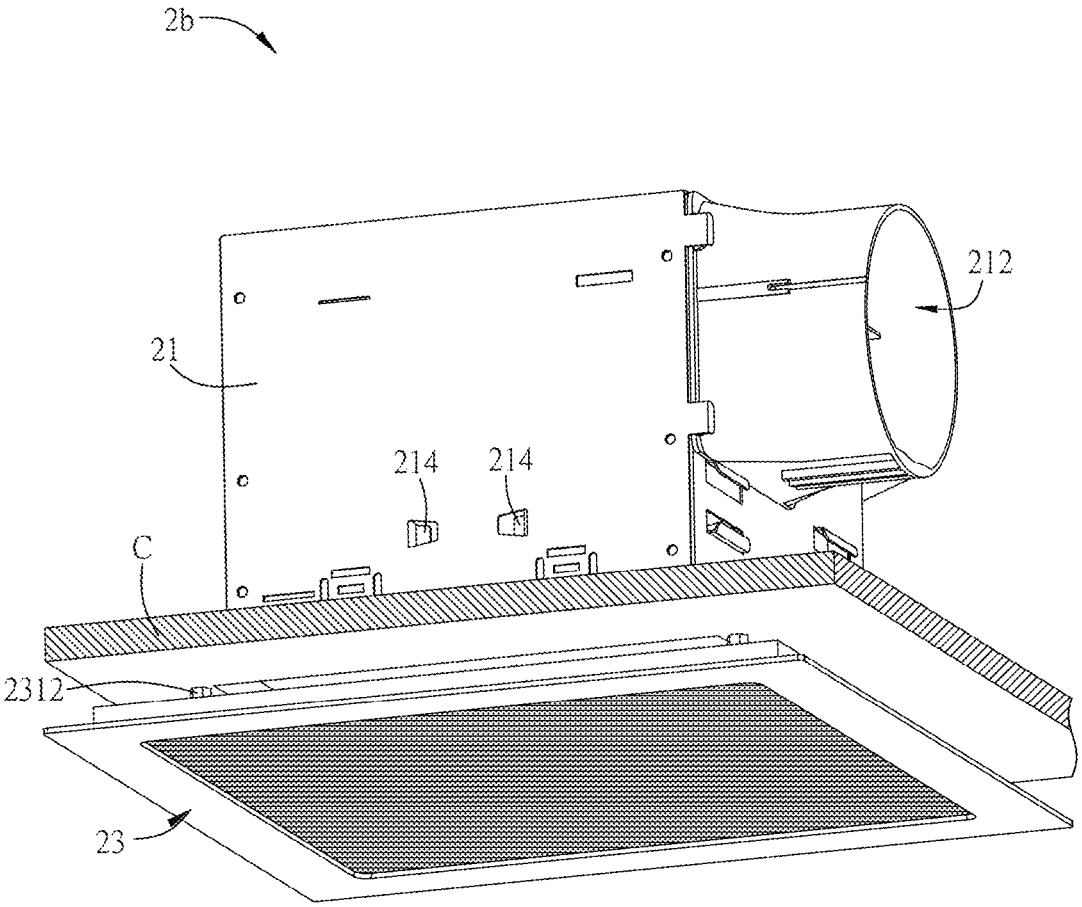
FIG. 6A is a schematic diagram of a ventilation fan with a lamp of the fifth embodiment of the invention.
Figure 6B:
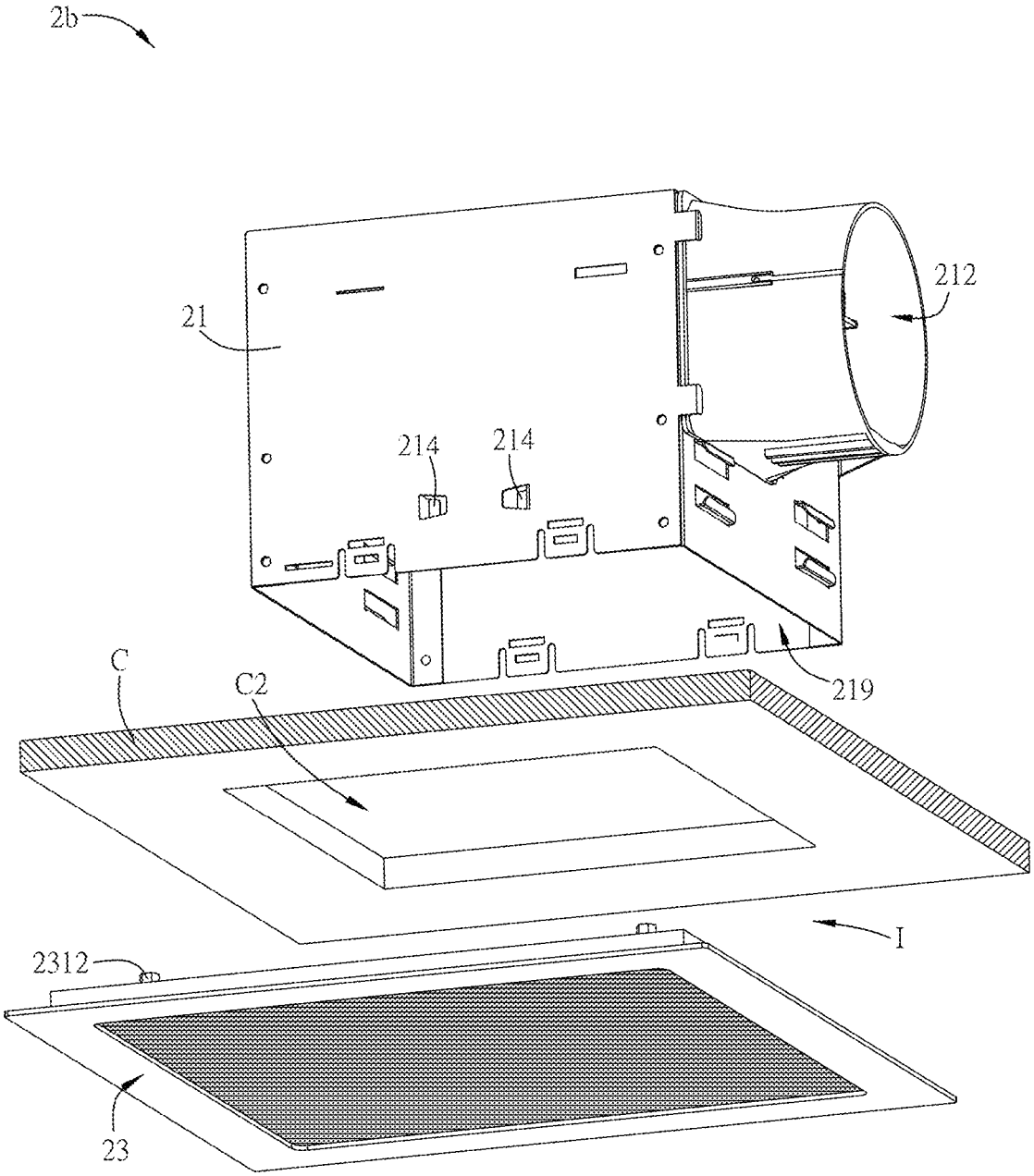
FIG. 6B is an exploded view of the ventilation fan of FIG. 6A
Figure 6C:
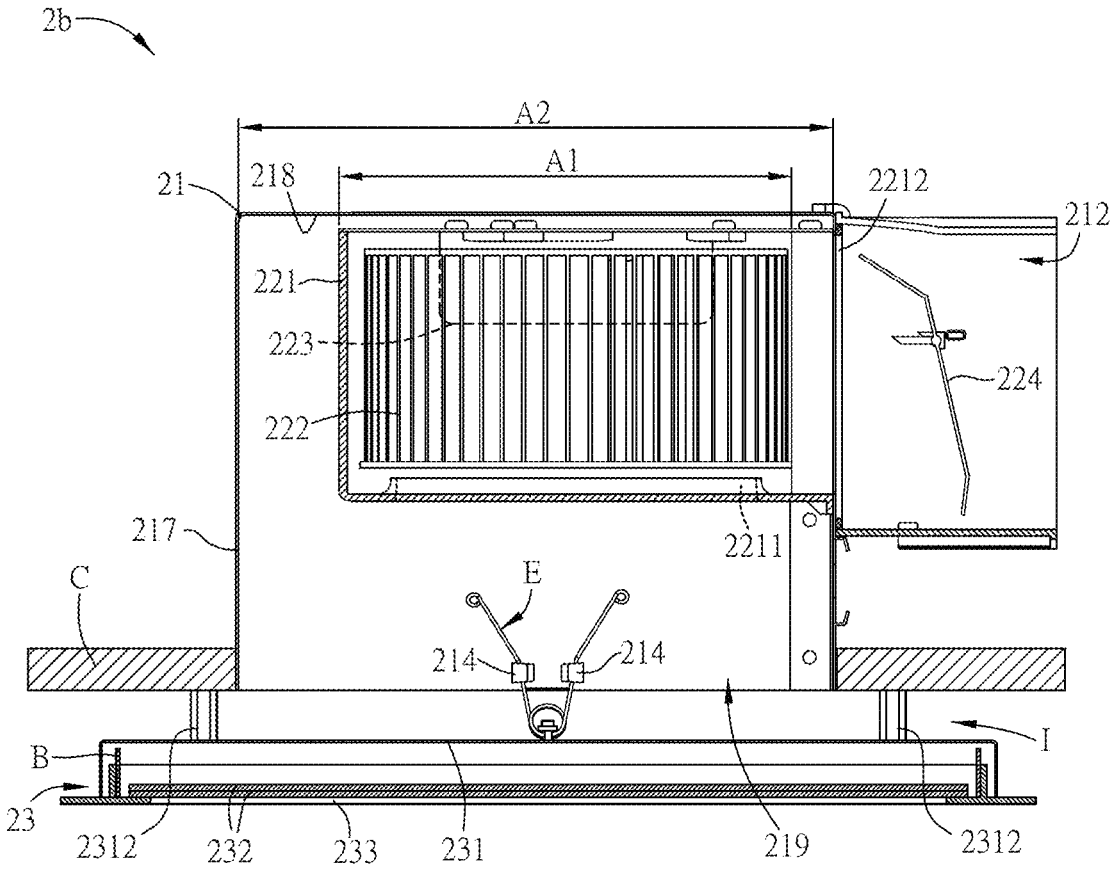
FIG. 6C is a sectional diagram of the ventilation fan of FIG. 6A.

As shown in FIGS. 6A to 6C, the ventilation fan 2*b* may be optionally configured without the support 25 so that the lamp module 23 can be directly contacted against the ceiling C via the contacting portion 2312 thereof. A gap I is formed between the lamp module 23 and the ceiling C, and the gap I is substantially the air inlet of the ventilation fan 2*b*. Moreover, the gap I between the lamp module 23 and the ceiling C can be properly adjusted by the contacting portion 2312 for matching the airflow field design of the ventilation fan 2*b*. That is, the length of the contacting portion 2312 is the same as the width of the gap I.

The other technical features of the ventilation fan 2*b* can be referred to the above-mentioned ventilation fan 2, and the detailed description thereof will be omitted.

In the following aspect, the housing of the ventilation fan further has a bottom plate, and the fan module is disposed corresponding to the opening.

Figure 7A:
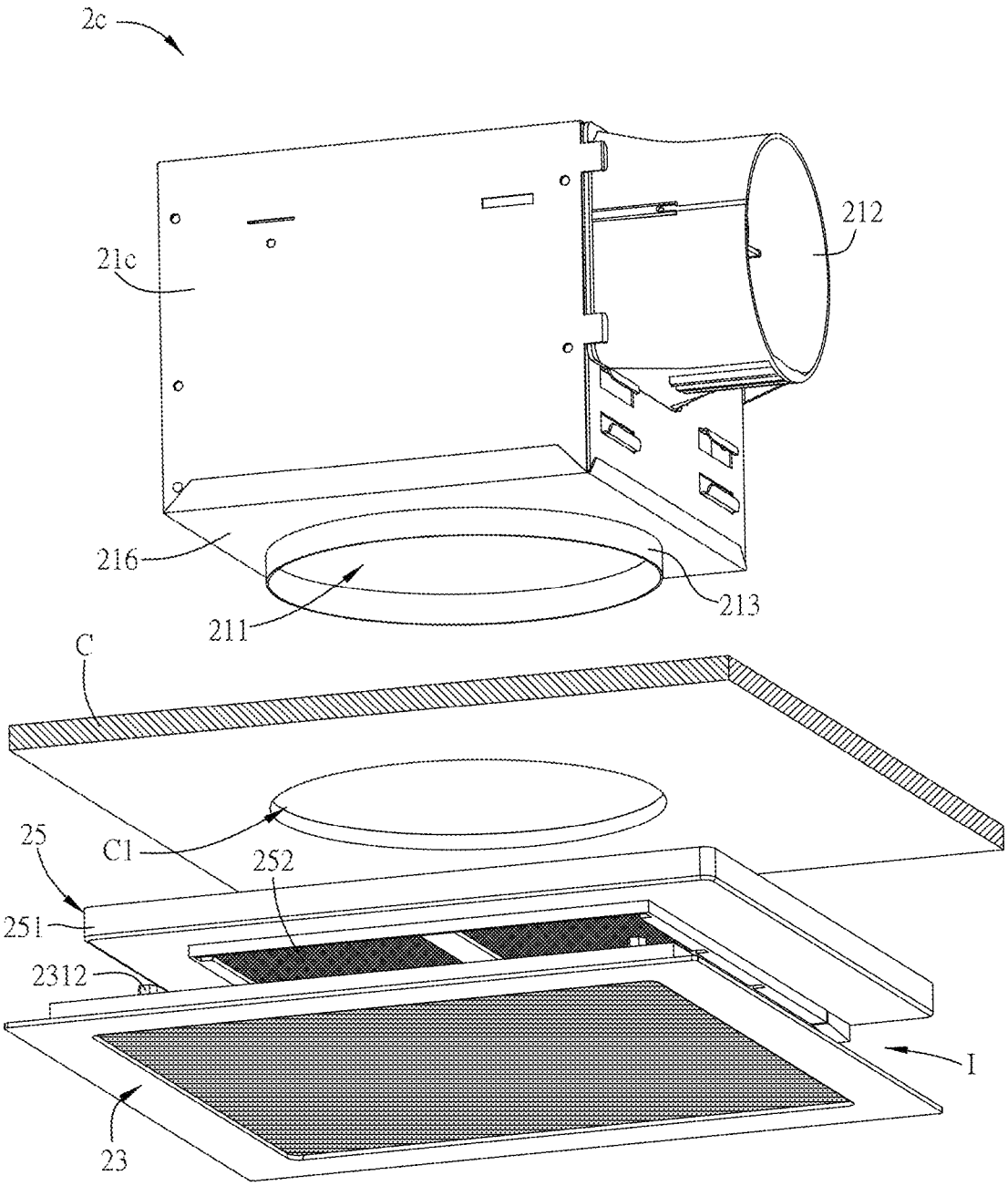
FIG. 7A is a schematic diagram of a ventilation fan with a lamp of the sixth embodiment of the invention.
Figure 7B:
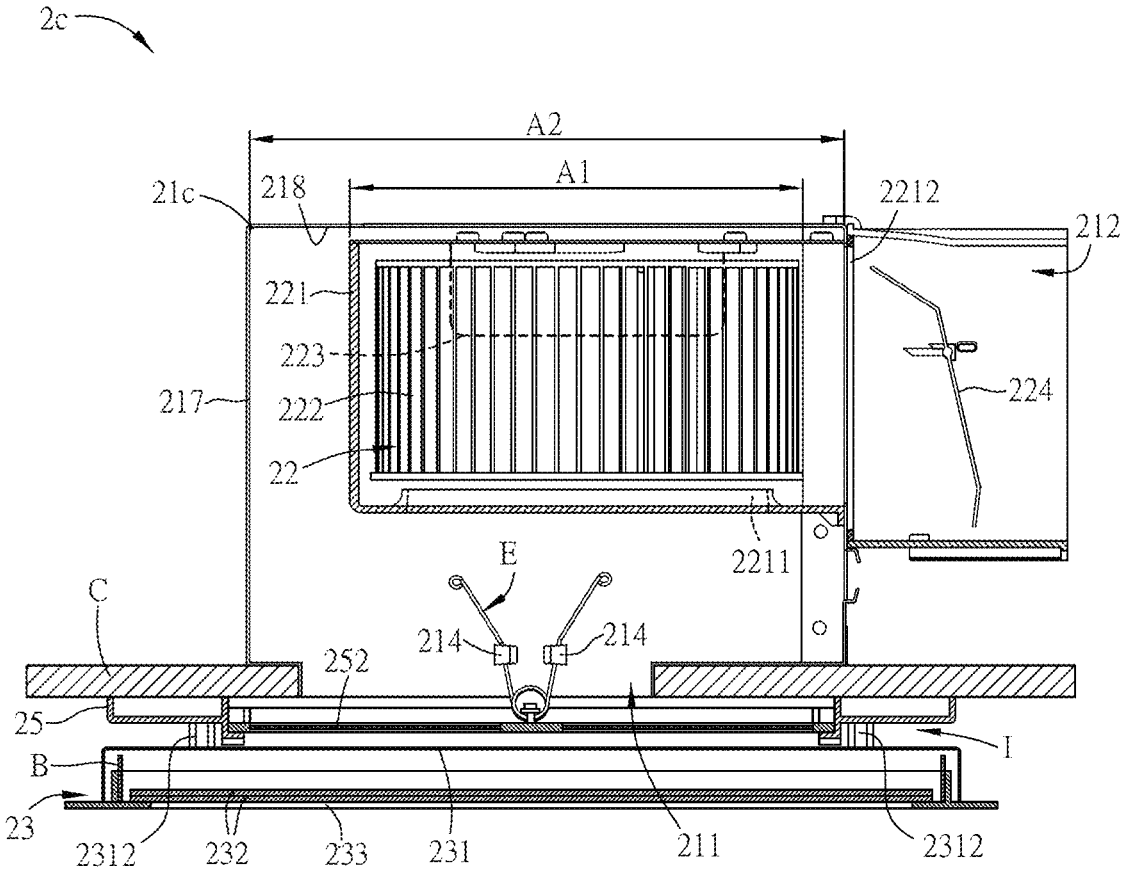
FIG. 7B is a sectional diagram of the ventilation fan of FIG. 7A.

FIG. 7A is a schematic diagram of a ventilation fan with a lamp of the sixth embodiment of the invention, and FIG. 7B is a sectional diagram of the ventilation fan of FIG. 7A.

The ventilation fan 2*c* of this embodiment is mostly the same as the ventilation fan 2. Different from the ventilation fan 2, the housing 21*c* of the ventilation fan 2*c* further includes a bottom plate 216, which connects to the side wall 217, and the bottom plate 216 is configured with a second opening 211 instead from the first opening 219. The second opening 211 is aligned with the installation opening C1. The configuration of the second opening 211 of the bottom plate 216 allows to install the housing 21*c* of the ventilation fan 2*c* on the ceiling C.

To be noted, the housing 21*c* is a rectangular box, containing the top plate 218, the side wall 217 and the bottom plate 216, with a second opening 211 formed on the bottom plate 216. The top plate 218 is parallel to the bottom plate 216. The top plate 218, the side wall 217 and the bottom plate 216 can be integrally formed as one piece or be assembled by multiple components. Besides, the top plate 218, the side wall 217 and the bottom plate 216 can be fabricated by dustproof, waterproof or fireproof material (e.g. plastics, metal or alloy).

As shown in FIG. 7A, the second opening 211 is aligned with the installation opening C1. Moreover, the second opening 211 has an annular wall portion 213 under the bottom plate 216. The height of the annular wall portion 213 is less than or equal to the thickness of the ceiling C. When aligning the second opening 211 and the annular wall portion 213 to the installation opening C1, the housing 21*c* can be smoothly fixed and installed to the ceiling C. In addition, the fan module 22 of this embodiment is installed corresponding to the second opening 211 and the installation opening C1. Moreover, the outer diameters of the motor 223 and the impeller 222 are smaller than the inner diameter of the second opening 211, respectively. This configuration can easily remove the components of the fan module 22 through the second opening 211 of the bottom plate 216 for performing the product repairing.

The other technical features of the ventilation fan 2*c* can be referred to the above-mentioned ventilation fan 2, so the detailed description thereof will be omitted.

Figure 7C:
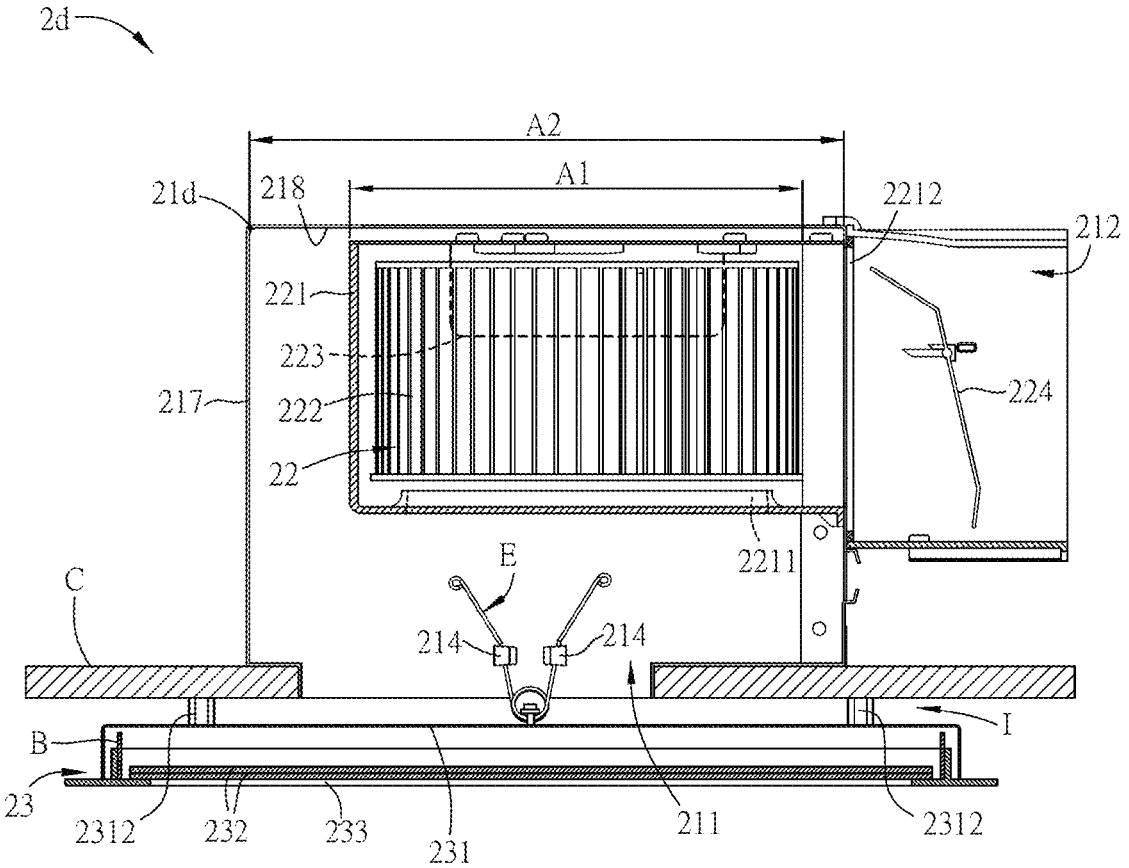
FIG. 7C is a sectional diagram of the ventilation fan of FIG. 7A with a variation.

The ventilation fan 2*d* of FIG. 7C is mostly the same as the ventilation fan 2*c* of FIG. 7B. Different from the ventilation fan 2*c*, the ventilation fan 2*d* does not have a support 25, so that the lamp module 23 contacts the ceiling C by the contacting portion 2312 thereof. A gap I is formed between the lamp module 23 and the ceiling C, and the gap I serves as a side-entry air inlet of the ventilation fan 2*d*.

In the following aspect, the ventilation fan has a bottom plate, and the fan module thereof is not corresponding to the second opening and the installation opening.

Figure 8:
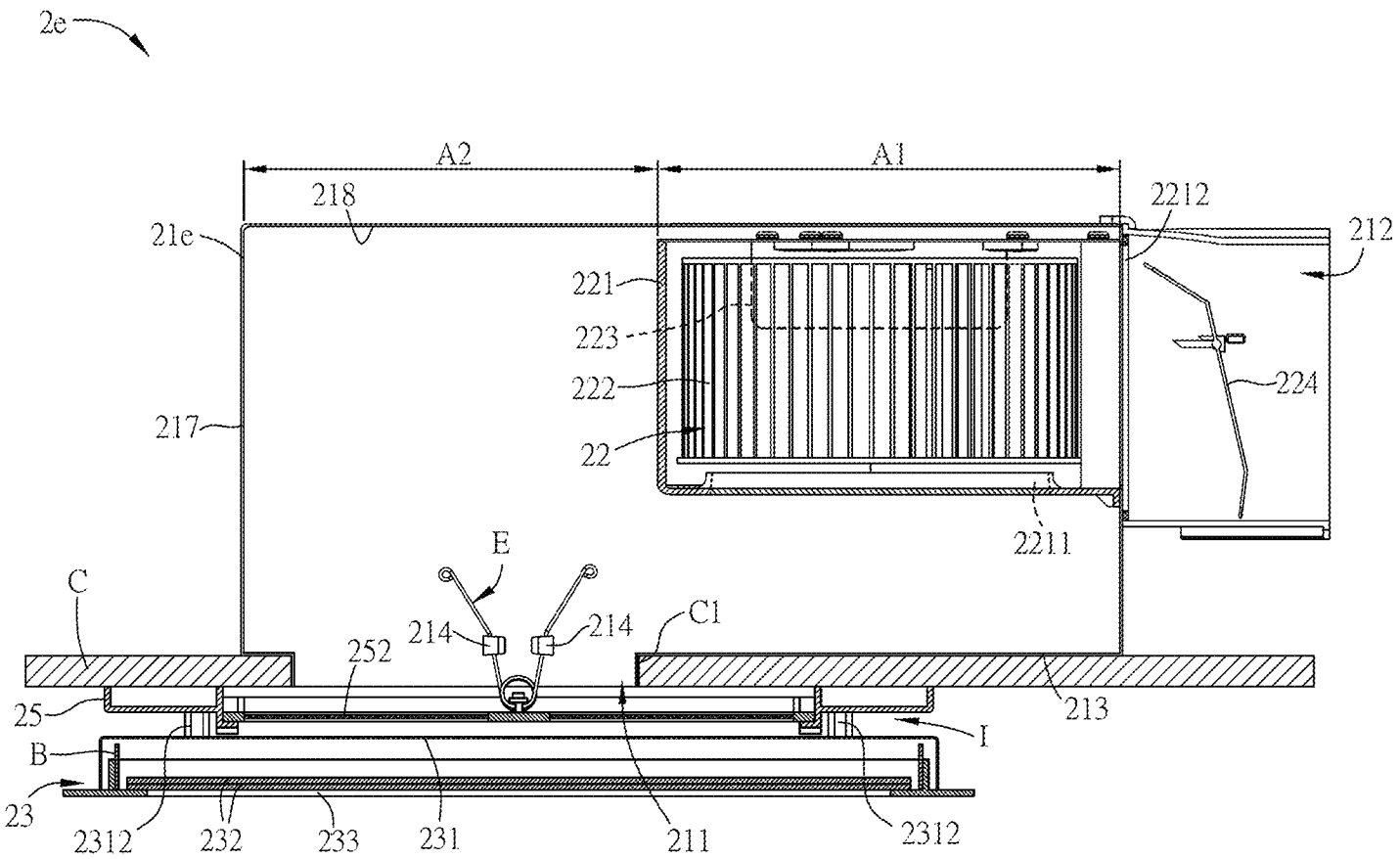
FIG. 8 is a sectional diagram of a ventilation fan of another aspect.

The ventilation fan 2*e* of FIG. 8 is mostly the same as the above-mentioned ventilation fan 2*c* shown in FIGS. 7A and 7B. Different from the ventilation fan 2*c*, the fan module 22 of the ventilation fan 2*e* is not aligned to the second opening 211 of the bottom plate 216 and the installation opening C1 of the ceiling C. The fan module 22 is not located on the projection plane of the second opening 211, and the elastic element E passes through the extending portion 214 of the housing 21*e*. In this embodiment, the fan module 22 has a first projection plane A1 on the top plate 218, and the installation opening C1 has a second projection plane A2 on the top plate 218. The first and second projection planes A1, A2 are substantially not overlapped. In brief, the fan module 22 is not located right above the installation opening C1 and the second opening 211. In this case, the fan module 22 is located aside the place right above the installation opening C1 and the second opening 211. Compared with the above-mentioned ventilation fan 2*c*, the housing 21*e* of the ventilation fan 2*e* of this embodiment has larger size, and it can be installed in the environment with larger installation space over the ceiling C.

Figure 10A:
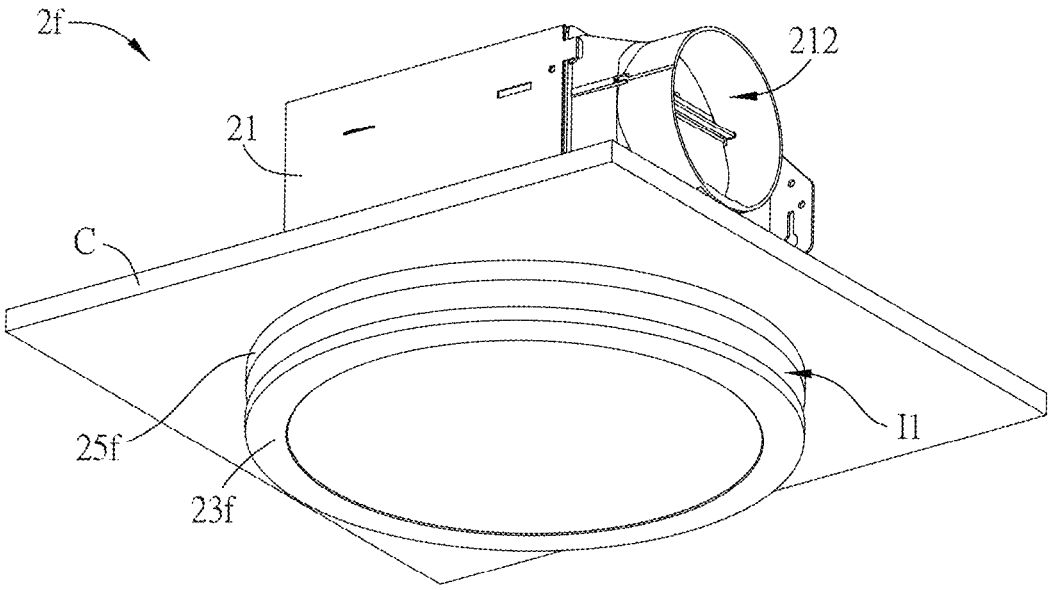
FIG. 10A is a schematic diagram of a ventilation fan with a lamp of the seventh embodiment of the invention.
Figure 10B:
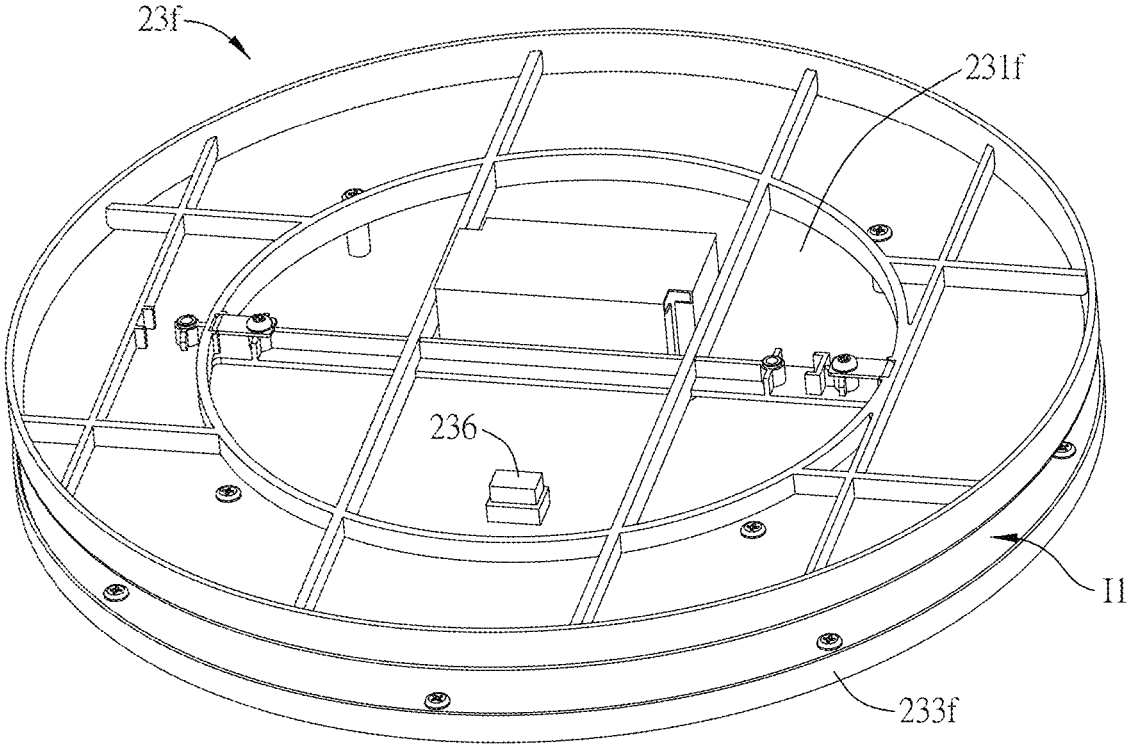
FIG. 10B is a schematic diagram of the lamp module of FIG. 10A.

FIG. 10A is a schematic diagram of a ventilation fan with a lamp of the seventh embodiment of the invention. FIG. 10B is a schematic diagram of the lamp module of FIG. 10A.

The ventilation fan 2*f* of FIG. 10A is mostly the same as the above-mentioned ventilation fan 2 shown in FIGS. 5A to 5D and 9A to 9B. Different from the ventilation fan 2 is the shape of the lamp module 23*f* and the support member 25*f* of the ventilation fan 2*f* The shape of the lamp module 23*f* and the support member 25*f* of the ventilation fan 2*f* is circular rather than rectangular of the ventilation fan 2.

As shown in FIGS. 10A and 10B, the lamp module 23*f* also has a switch 236*f* The switch 236*f* is disposed on the base 231*f* and towards to the installation opening of the ceiling C. The switch 236*f* and other technical features of the ventilation fan 2*f* can be referred to the above-mentioned ventilation fan 2, so the detailed description thereof will be omitted.

Figure 11A:
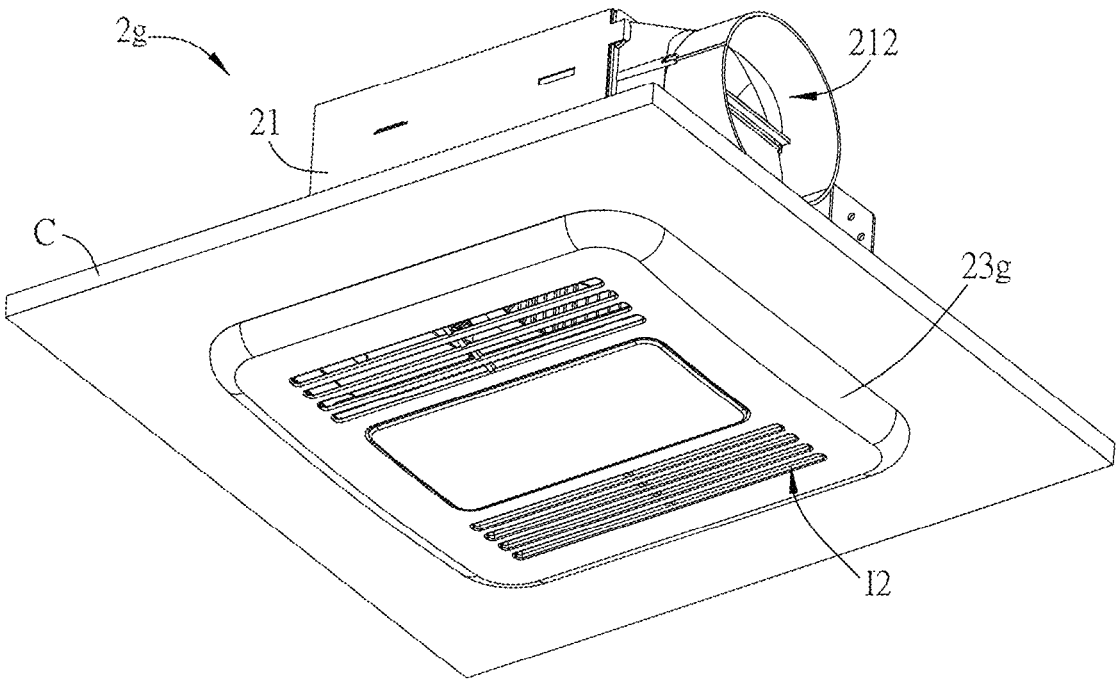
FIG. 11A is a schematic diagram of a ventilation fan with a lamp of the eighth embodiment of the invention.
Figure 11B:
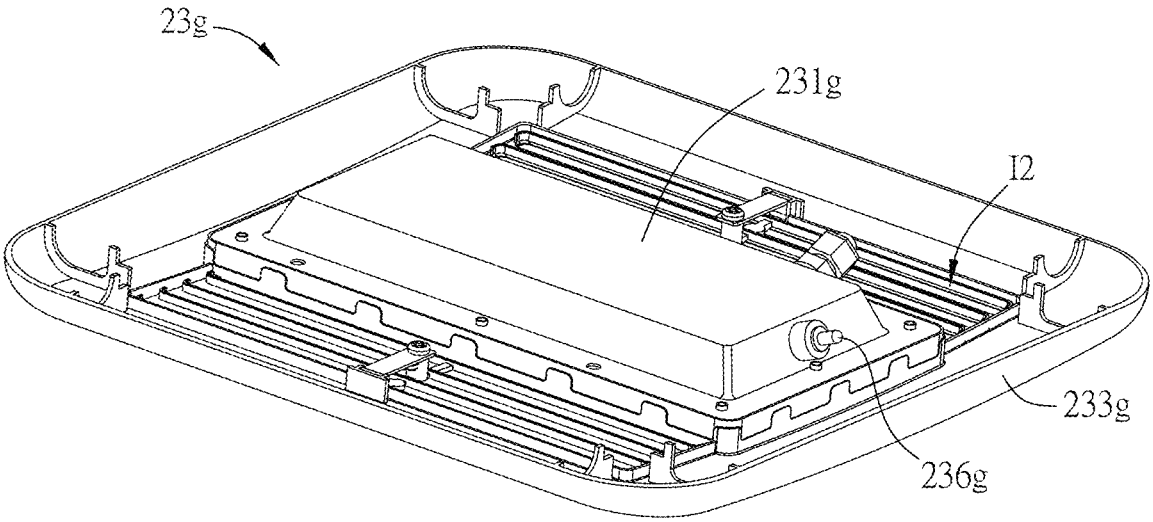
FIG. 11B is a schematic diagram of the lamp module of FIG. 11A.

FIG. 11A is a schematic diagram of a ventilation fan with a lamp of the eighth embodiment of the invention. FIG. 11B is a schematic diagram of the lamp module of FIG. 11A.

The ventilation fan 2*g* of this embodiment is mostly the same as the ventilation fan 2. Different from the ventilation fan 2, the lamp cover 233*g* of the ventilation fan 2*g* further includes a through hole 12, which serve as an air inlet of the ventilation fan. Moreover, the lamp cover 233*g* is directly attached to the ceiling C. Therefore, the ventilation fan 2*g* does not include the support 25 and the gap I as recited in ventilation fan 2.

As shown in FIGS. 11A and 11B, the lamp module 23*g* also has a switch 236*g*. The switch 236*g* is disposed on the base 231*g*. The switch 236*g* and other technical features of the ventilation fan 2g can be referred to the above-mentioned ventilation fan 2, so the detailed description thereof will be omitted.

In summary, the ventilation fan with the lamp of this disclosure is installed to the ceiling having an installation opening. The ventilation fan includes a housing, a fan module, and a lamp module. The housing has a top plate and a side wall. The top plate and the side wall are connected with each other and form a first opening. The first opening is aligned with the installation opening. The fan module is disposed in the housing. The lamp module is disposed out of the installation opening, and the lamp module and the housing are located at opposite sides of the installation opening of the ceiling. The lamp module can further block the noise generated by the fan module in operation. Besides, the internal structure of the ventilation fan cannot be viewed by the user directly, so that the appearance of the ventilation fan becomes more elegant. Since the lamp module is integrated in the ventilation fan, it can be fit to various environments so the flexibility and freedom degree for installing the ventilation fan are enhanced. Moreover, this disclosure can reduce the required installation space of the ceiling so as to increase the utility rate of the space. Since the lamp module and the first opening are disposed at opposite sides of the ceiling, the ventilation fan can have large inlet quantity and good air-exchange efficiency. Further, the lamp module has a switch to provide the light dimming function like changing the light color, light color temperature, the brightness and the light frequency, so that the ventilation fan of the disclosure can provide multiple illumination modes for various situations.

Although the present invention is described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A ventilation system comprising a ventilation fan with a lamp and a ceiling having an installation opening, wherein the ventilation fan with the lamp is adapted for installing to the ceiling through the installation opening, the ventilation fan comprises:

a housing including a top plate and a side wall, wherein the top plate and the side wall are connected with each other to form a first opening, and the first opening is aligned with the installation opening;

a fan module disposed in the housing;

a lamp module totally disposed below the ceiling and out of the installation opening, wherein the lamp module and the housing are located at opposite sides of the installation opening of the ceiling, respectively;

a support disposed between the ceiling and the lamp module; and a contacting portion connecting the lamp module and the support and disposed between the lamp module and the support;

wherein the lamp module includes a light source, a base, at least one optical component, a switch and a lamp cover, wherein the light source, the base, the at least one optical component, the switch and the lamp cover are totally disposed below the ceiling and out of the installation opening, the optical component and the switch are disposed at different sides of the base, respectively, wherein the lamp cover is disposed at one side of the optical component away from the base, and the switch is disposed on the base and towards the installation opening, wherein the lamp module is under the contacting portion which is under the support, and the support is under the ceiling, wherein the support and the lamp module are parallel, the contacting portion is vertical to the lamp module and the support respectively, a gap is configured between the lamp module and the support, a length of the contacting portion is equal to a height of the gap.

2. The ventilation system as recited in claim 1, wherein the light source comprises at least one light-emitting diode.

3. The ventilation system as recited in claim 1, wherein the gap serves as an air inlet of the ventilation fan.

4. The ventilation system as recited in claim 3, further comprising a second opening disposed at the housing and serving as an air outlet of the ventilation fan.

5. The ventilation system as recited in claim 1, wherein the switch comprises a water-proof structure.

6. The ventilation system as recited in claim 5, wherein the switch is a multi-stage switch.

7. The ventilation system as recited in claim 6, wherein the switch is disposed to control light color, light color temperature or brightness of the lamp module.

8. The ventilation system as recited in claim 1, wherein the lamp cover is attached to the ceiling.

* * * * *